US007526242B2

(12) United States Patent
Takagaki et al.

(10) Patent No.: US 7,526,242 B2
(45) Date of Patent: Apr. 28, 2009

(54) TRANSFERRING APPARATUS AND IMAGE FORMING APPARATUS

(75) Inventors: Hiromitsu Takagaki, Kanagawa (JP); Takashi Fujita, Kanagawa (JP); Atsushi Nakafuji, Tokyo (JP); Hirohmi Tamura, Kanagawa (JP); Hiroyuki Kunii, Kanagawa (JP); Kohji Ue, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 265 days.

(21) Appl. No.: 11/521,494

(22) Filed: Sep. 15, 2006

(65) Prior Publication Data

US 2007/0065188 A1 Mar. 22, 2007

(30) Foreign Application Priority Data

Sep. 16, 2005 (JP) ..... 2005-269743
Jul. 14, 2006 (JP) ..... 2006-193639
Aug. 10, 2006 (JP) ..... 2006-218770

(51) Int. Cl.
*G03G 15/16* (2006.01)
*G03G 15/20* (2006.01)
*G03G 15/00* (2006.01)

(52) U.S. Cl. ..... 399/307; 399/322; 399/400

(58) Field of Classification Search ..... 399/307, 399/322, 323, 400, 406
See application file for complete search history.

(56) References Cited

U.S. PATENT DOCUMENTS 7,031,648 B2 1/2005 Takashi et al.
7,003,251 B2 * 2/2006 Suzuki et al. ..... 399/309
2003/0118357 A1 * 6/2003 Fromm et al. ..... 399/21
2005/0025534 A1 2/2005 Fujita et al.
2005/0152721 A1 7/2005 Kikuchi et al.
2005/0201783 A1 9/2005 Kurotaka et al.
2005/0207801 A1 9/2005 Kunii et al.
2005/0286920 A1 12/2005 Baba et al.
2006/0008302 A1 1/2006 Someya et al.
2006/0013624 A1 1/2006 Kurotaka et al.
2006/0120776 A1 6/2006 Takashi et al.
2006/0140689 A1 6/2006 Echigo et al.
2007/0065188 A1 3/2007 Takagaki et al.

FOREIGN PATENT DOCUMENTS

JP 59-77471 5/1984
JP 64-698 1/1989

(Continued)

OTHER PUBLICATIONS

U.S. Appl. No. 12/100,068, filed Apr. 9, 2008, Yoshinaga et al.

(Continued)

*Primary Examiner*—Hoang Ngo
(74) *Attorney, Agent, or Firm*—Oblon, Spivak, McClelland, Maier & Neustadt, P.C.

(57) ABSTRACT

A first guide member and a second guide member guide a recording medium into a nip between a transfer member and a nip-forming member. The first guide member and the second guide member are arranged so as to form a substantial V-shape with tip of the V-shape being toward the nip. A distance between the first guide member and the second guide member at the tip being equal to or less than 5 millimeters.

15 Claims, 12 Drawing Sheets

FOREIGN PATENT DOCUMENTS

| | | |
|---|---|---|
| JP | 3-100871 | 10/1991 |
| JP | 6-236128 | 8/1994 |
| JP | 8-190290 | 7/1996 |
| JP | 2000-281241 | 10/2000 |
| JP | 2002-72701 | 3/2002 |
| JP | 2002-214947 | 7/2002 |
| JP | 2002-221839 | 8/2002 |
| JP | 2002-244450 | 8/2002 |
| JP | 3428213 | 5/2003 |
| JP | 2003-287939 | 10/2003 |
| JP | 2004-145260 | 5/2004 |
| JP | 3610737 | 10/2004 |

OTHER PUBLICATIONS

U.S. Appl. No. 11/757,150, filed Jun. 1, 2007, Seto et al.
U.S. Appl. No. 12/042,143, filed Mar. 4, 2008, Kayahara, et al.

* cited by examiner

TRANSFERRING APPARATUS AND IMAGE FORMING APPARATUS

CROSS-REFERENCE TO RELATED APPLICATIONS

The present document incorporates by reference the entire contents of Japanese priority documents, 2005-269743 filed in Japan on Sep. 16, 2005, 2006-193639 filed in Japan on Jul. 14, 2006 and 2006-218770 filed in Japan on Aug. 10, 2006.

BACKGROUND OF THE INVENTION

1. Field of the Invention

The present invention relates to a transferring apparatus that transfers a visible image formed on an image carrier onto a recording medium and fixes the image to the recording medium. The present invention also relates to an image forming apparatus using the transferring apparatus.

2. Description of the Related Art

There has been known an image forming apparatus that, after transferring a visible image such as a toner image formed on an image carrier to a recording sheet such as transfer paper, feeds the recording sheet into a fixing apparatus to fix the visible image. In this type of image forming apparatus, an unfixed visible image could be disturbed due to a contact of an image carrier surface to the recording sheet around an inlet, a guide plate, or the like of a fixing apparatus, when the recording sheet is to be fed into the fixing apparatus while the visible image transferred is yet unfixed.

On the other hand, there has been known an image forming apparatus where transferring processing and fixing processing of a visible image to a recording sheet are substantially and simultaneously performed by a transfer/fixing apparatus (for example, see Japanese Patent Application Laid-open No. 2004-145260). A transfer/fixing apparatus in this type of image forming apparatus includes a transfer member, a nip forming member that are endlessly moved while surfaces thereof are contacting with each other, and a heating unit that heats a visible image. After a visible image, which is carried on such an image carrier as an intermediate transfer member, is transferred on a surface of a transfer member, the visible image advances to a transfer fixing nip formed by contacting portions of two surfaces of endless moving members, while the visible image is heated by the heating unit. A recording sheet is fed into the transfer fixing nip in synchronization with the advancing of the visible image. The visible image on the surface of the transfer member is fixed on the fed-in recording sheet while being transferred thereon. With this configuration, transferring processing and fixing processing of the visible image to the recording sheet are substantially and simultaneously performed in the transfer fixing nip in the transfer/fixing apparatus. Thereby, after the visible image is transferred on the recording sheet, the recording sheet is conveyed so that the visible image fixed. Therefore, this configuration can avoid a problem such that the unfixed visible image is disturbed due to rubbing the image against a guide plate or the like.

However, since it is necessary to heat a visible image on a surface of a first endless moving member prior to advancing to a nip, the transfer/fixing apparatus tends to have a larger heat loss amount than a fixing apparatus that performs fixing processing only in a nip. Therefore, it is desired that the heat loss be reduced as much as possible.

The present invention has been achieved in view of these circumstances, and an object of the invention is to provide a transferring apparatus and an image forming apparatus as described below. That is, the object is to provide a transferring apparatus that avoids a problem such that an unfixed image is disturbed due to rubbing of the image against a guide plate or the like, and can further reduce a heat loss amount as compared with former transfer fixing apparatus, and the like.

SUMMARY OF THE INVENTION

It is an object of the present invention to at least partially solve the problems in the conventional technology.

According to one aspect of the present invention, a transferring apparatus that receives a visible image carried on an image carrier, and transfers the image to a recording medium includes a transfer member configured to receive toner corresponding to the image from the image carrier; a heating unit that heats the transfer member having the image thereon thereby heating the toner on the transfer image; a nip-forming member configured to form a nip between the transfer member, and sandwich a recording medium in the nip thereby transferring hot toner from the transfer member to the recording medium for transferring the image from the transfer member onto the recording medium; and a first guide member and a second guide member that guide the recording medium toward the nip, the first guide member and the second guide member being arranged so as to form a substantial V-shape with tip of the V-shape being toward the nip, and a distance between the first guide member and the second guide member at the tip being equal to or less than 5 millimeters.

According to another aspect of the present invention, a transferring apparatus that receives a visible image carried on an image carrier, and transfers the image to a recording medium includes a transfer member configured to receive toner corresponding to the image from the image carrier; a heating unit that heats the transfer member having the image thereon thereby heating the toner on the transfer image; a nip-forming member configured to form a nip between the transfer member, and sandwich a recording medium in the nip thereby transferring hot toner from the transfer member to the recording medium for transferring the image from the transfer member onto the recording medium; and a covering member that covers an inlet side of the nip and is provided with an opening through which the recording medium advances toward the nip, the opening having a first length that is wider than width of the recording medium and a second length that is equal to or less than 5 millimeters.

According to still another aspect of the present invention, an image forming apparatus includes the above transferring apparatus.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 19 is an enlarged diagram of a first inlet shutter and a second inlet shutter being open to admit a recording sheet coming in;

DETAILED DESCRIPTION OF THE PREFERRED EMBODIMENTS

Exemplary embodiments according to the present invention will be explained below.

Figure 1:
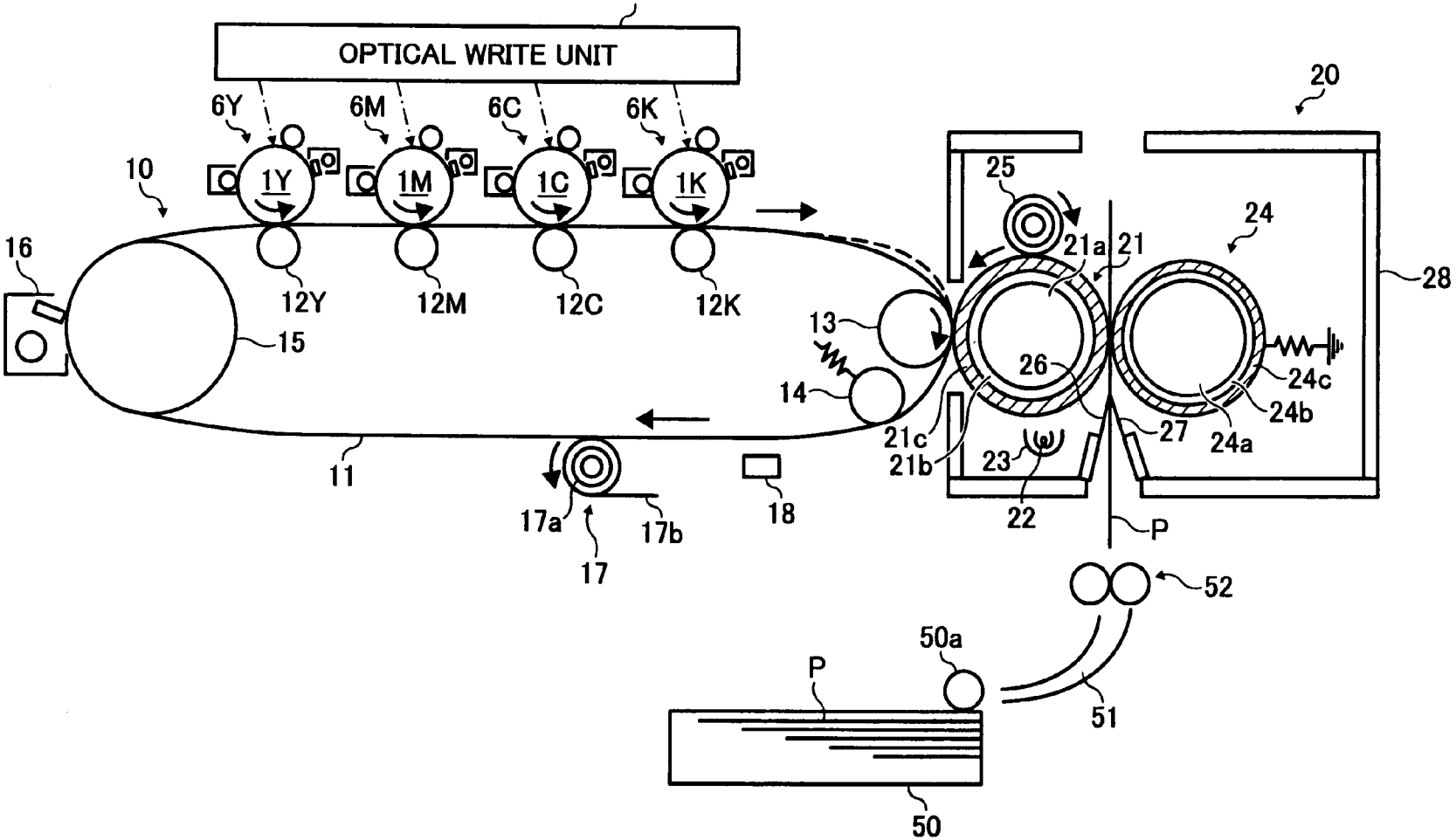
FIG. 1 is a schematic of a printer according to a first embodiment of the present invention.

A basic configuration of the printer will be first explained. FIG. 1 is a schematic of the printer. As shown in FIG. 1, the printer includes four process units 6Y, 6M, 6C, and 6K that produce toner images of yellow, magenta, cyan, and black (hereinafter, "Y, M, C, and K"). The process units use Y, M, C, and K toners different from one another as image forming substances, however, having the same configuration except for toners to be used and being replaced with fresh ones at the ends of their lives.

Figure 2:
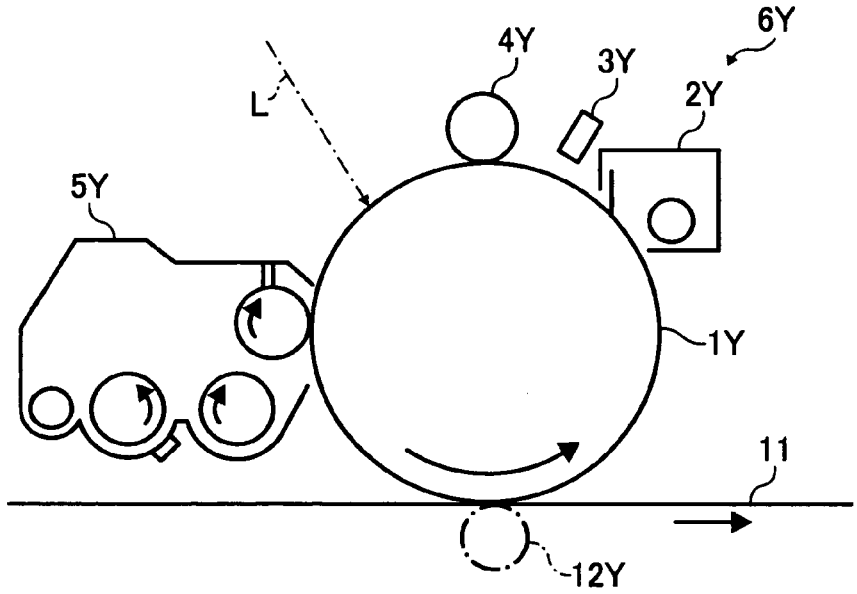
FIG. 2 is an enlarged diagram of a process unit for Y (yellow) shown in FIG. 1.

As shown in FIG. 2, for example, the process unit 6Y that produces a Y toner image includes a drum-shaped photoconductor 1Y, a drum-cleaning device 2Y, a charge-removing device 3Y, a charging device 4Y, a developing device 5Y, and the like. The photoconductor 1Y is formed by coating a photoconductor layer on a drum-shape metal raw pipe and it is rotationally driven in a counterclockwise direction shown in FIG. 2 by a drive unit (not shown). The photoconductor 1Y can be formed in a belt shape instead of the drum shape. The charging device 4Y includes a charging roller applied with charging bias by a charging bias power source (not shown) while being caused to contact with or approach to the photoconductor 1Y, and it charges a surface of the photoconductor 1Y evenly according to discharging from the charging roller. Instead of the charging roller, a charging brush can be caused to contact with or approach to the photoconductor 1Y. The surface of the photoconductor 1Y can be charged evenly by corona charging. The surface of the photoconductor 1Y that has been charged evenly is exposure-scanned with laser light L emitted from an optical write unit described later to carry an electrostatic latent image for Y. The electrostatic latent image for Y is developed to a Y toner image by the developing device 5Y using Y toner. The developed image for Y is temporarily transferred on an intermediate transfer belt 11. The drum cleaning device 2Y removes toner remaining on the surface of the photoconductor 1Y that has been subjected to an intermediate transferring step. The charge-removing device 3Y removes residual charge on the photoconductor 1Y after cleaned. According to the charge removing, the surface of the photoconductor 1Y is initialized to prepare for the next image forming. Similarly, M, C, K toner images are also formed on photoconductors 1M, 1C, and 1K to be transferred on the intermediate transfer belt 11 in the process units 6M, 6C, and 6K for the other colors.

As shown in FIG. 1 described above, an optical write unit 7 is disposed above the process units 6Y, 6M, 6C, and 6K. The optical write unit 7 that serves as a latent image forming unit performs optical scanning on the respective photoconductors in the process units 6Y, 6M, 6C, and 6K by laser light L emitted based on image information or data transmitted from a personal computer (not shown). By the optical scanning, electrostatic latent images for Y, M, C, and K are formed on the photoconductors 1Y, 1M, 1C, and 1K. The optical write unit 7 irradiates laser light (L), emitted from a light source on the photoconductors via a plurality of optical lenses or mirrors while scanning. The laser light scans in a main scanning direction reflected by a polygon mirror (not shown) rotationally driven by a motor. Instead of the optical write unit 7 thus configured, a configuration for irradiating light-emitting diode (LED) light from an LED array can be adopted.

A paper feed cassette 50, which accommodates a plurality of sheets of transfer paper P that is recording members in a stacking manner where the sheets of transfer paper P are stacked, is disposed below the intermediate transfer belt 11 shown in FIG. 1. A paper feed roll 50*a* is pushed on the uppermost transfer paper P. The uppermost transfer paper P is fed out to a paper feed path 51 by rotationally driving the paper feed roll 50*a*. The fed-out transfer paper P is fed toward between rollers of a registration roller pair 52 disposed at a rear end of the paper feed path 51. The registration roller pair 52, serving as a sheet supply unit, rotationally drives both of the rollers for sandwiching transfer paper P, and temporary stops rotation of the rollers just after the rollers sandwich the same. The registration roller pair 52 feeds the transfer paper P toward a transfer fixing nip described later.

An intermediate transfer unit 10 that endlessly moves the intermediate transfer belt 11 that is an intermediate transfer member and is an image carrier while spanning the same is disposed below the process units 6Y, 6M, 6C, and 6K shown in FIG. 1. Besides the intermediate transfer belt 11, the intermediate transfer unit 10 includes a belt cleaning device 16, a cooling device 17, a belt mark sensor 18, and the like. The intermediate transfer unit 10 also includes a spanning roller group that includes four first transfer bias-rollers 12Y, 12M, 12C, and 12K, a drive roller 13, a tensioning roller 14, and a cleaning backup roller 15. The intermediate transfer belt 11 is spanned with a predetermined tension while a back face (a loop inner circumferential face) thereof is being supported by the respective rollers of the spanning roller group. The intermediate transfer belt 11 is endlessly moved in a clockwise direction as shown in FIG. 1 by the drive roller 13, which is rotationally driven by a drive unit (not shown) in a clockwise direction.

The four first transfer bias-rollers 12Y, 12M, 12C, and 12K sandwich the intermediate transfer belt 11 endlessly moved between them and the photoconductors 1Y, 1M, 1C, and 1K to form a first transfer nips. While the first transfer bias-rollers adopt a system for applying transfer biases with a polarity reverse (for example, a plus polarity) to that of the toners to a back face (the loop inner circumferential face) of the intermediate transfer belt 11, so as to configure a charge system for performing discharge from electrodes.

In a process that the intermediate transfer belt 11 sequentially passes through the first transfer nips for Y, M, C, and K due to an endless movement thereof, the Y, M, C, and K toner images on the photoconductors 1Y, 1M, 1C, and 1K are primarily transferred on the intermediate transfer belt 11 in superimposition with one another. Thereby, a four-color superimposed toner image (hereinafter, "four-color toner image") is formed on the intermediate transfer belt 11.

A transfer/fixing apparatus 20 including a transfer fixing roller 21 and the like is disposed on the right side of the intermediate transfer unit 10 shown in FIG. 1, and sandwiches the intermediate transfer belt 11 between the transfer fixing roller 21 and the drive roller 13 in the intermediate transfer unit 10 so as to form a second nip. Second transfer bias having minus voltage (−0.5 to −2 kV) that is the same polarity as the toners is applied to the drive roller 13 in the intermediate transfer unit 10 by a power source (not shown). On the other hand, the transfer fixing roller 21 in the transfer/fixing apparatus 20 is grounded. As a result, second transfer field that electro-statically moves the toner from the belt side toward the transfer fixing roller 21 is formed in the second transfer nip, which is a contacting portion between the intermediate transfer belt 11 and the transfer fixing roller 21. The transfer fixing roller 21 in the transfer/fixing apparatus 20 is heated up to about 100° C. A surface of the transfer fixing roller 21 is set to be coarser than that of the intermediate transfer belt 11.

The four-color toner image formed on the front face of the intermediate transfer belt 11 according to passage thereof trough the four first transfer nips advances in the second transfer nip according to endless movement of the intermediate transfer belt 11. The four-color toner image is secondarily transferred collectively from the front face of the intermediate transfer belt 11 to a surface of the transfer fixing roller 21 under second transfer field and nip pressure. At this time, toner forming the four-color toner image is softened due to heating from the transfer fixing roller 21 so that adherence of the toner to the transfer fixing roller 21 with the surface coarser than the belt surface is increased. Accordingly, the second transfer is improved.

A plurality of patch-like belt marks (not shown) made from a material favorable in light reflectivity such as aluminum is fixed on one end portion of the intermediate transfer belt 11 in a belt width direction over a whole circumference of the belt at a predetermined pitch. The belt marks are detected by a belt mark sensor 18 that is a reflection type photo-sensor arranged to face the surface of the intermediate transfer belt 11 that has passed through the second transfer nip via a predetermined gap.

The endless movement speed of the intermediate transfer belt 11 varies slightly due to the eccentricity of a drive-transmission gear or thickness deviation of the belt even if the intermediate transfer belt 11 is rotated at a constant speed by a drive motor serving as a drive source for the drive roller 13. When the intermediate transfer belt 11 is endlessly moved at a constant speed, the mark detection interval obtained by the belt mark sensor 18 becomes a predetermined time interval. However, when speed fluctuation of the intermediate transfer belt 11 occurs, the mark detection interval varies. The printer includes a belt speed control circuit (not shown), and' the belt speed control circuit detects speed fluctuation of the intermediate transfer belt 11 based on an output signal from the belt mark sensor 18 to feed back the detection result to the drive speed of the drive motor. Thereby, the speed fluctuation of the intermediate transfer belt 11 is suppressed.

A cooling device 17 including a heat pipe 17*a*, a cleaning blade 17*b*, and the like is disposed on the left side of the belt mark sensor 18 shown in FIG. 1, where the heat pipe 17*a* is rotated in contact with the front face of the intermediate transfer belt 11. A coolant (not shown) is included in the heat pipe 17*a*, and it efficiently absorbs heat conducted through the pipe. Thereby, the intermediate transfer belt 11, of which temperature has been raised due to a contact with the transfer fixing roller 21 in the second transfer nip, is cooled. Since remaining post-transfer toner that has not been transferred on the transfer fixing roller 21 in the second transfer nip adheres on the front face of the intermediate transfer belt 11, a portion of the remaining post-transfer toner can adhere on the heat pipe 17*a*. The remaining post-transfer toner that has adhered on the heat pipe 17*a* is removed by the cleaning blade 17*b* contacting with the heat pipe 17*a*.

The belt cleaning device 16 is disposed to sandwich the intermediate transfer belt 11 between the same and the cleaning backup roller 15 on the left side of the intermediate transfer belt 11 shown in FIG. 1. When the intermediate transfer belt 11 that has been cooled by the cooling device 17 passes through a cleaning position, which is a contacting position with the belt cleaning device 16, the remaining post-transfer toner on the front face thereof is cleaned. Thereafter, the intermediate transfer belt 11 sequentially passes through the four first transfer nips to be formed thereon with a four-color toner image.

Besides the transfer fixing roller 21, the transfer/fixing apparatus 20 includes a halogen lamp 22, a reflecting plate 23, a pressurizing roller 24, a cleaning roller 25, a first guide plate 26, a second guide plate 27, a casing 28 that is a housing, and the like.

The transfer fixing roller 21 includes a cored bar 21*a* made from metal such as aluminum and an adiabatic layer 21*b* made from a hard material such as porous ceramic or glass and formed on a surface of the cored bar 21*a*. The transfer fixing roller 21 also includes an elastic layer 21*c* with a thickness of 0.05 to 0.5 millimeter made from an elastic material such as silicon rubber, that is formed on a surface of the adiabatic layer 21*b*, and a surface layer (not shown) with a thickness of 10 to 30 micrometers made from a fluorine resin material such as perfluoroalkoxy polymer resin (PFA) or polytetrafluoroethylene (PTFE) coated on a surface of the elastic layer. The surface layer made from a fluorine resin material is formed on the surface of the elastic layer 21*c* by material coating or thermal shrinkage of tube material, and it develops favorable releasing performance to toner adhered on the surface layer. It is preferable that the cored bar 21*a* has a thickness or a diameter equal to or less than 1 millimeter for shortening a temperature-rising time. It is also preferable that heat conductivity of the adiabatic layer 21*b* is set equal to or less than 0.1 W/mK, and compression strength thereof is set equal to or more than 3 megapascal for achieving both of high adiabatic performance and compression strength enduring load acting on a transfer fixing nip described later. It is preferable that the elastic layer 21*c* has a thickness of equal to or more than 0.1 millimeter for securing a fixed surface layer universal hardness, and it is also preferable that the elastic layer 21*c* has a thickness equal to or less than 0.5 millimeter for shortening the temperature-rising time. It is preferable that the surface layer has a thickness equal to or less than 30 micrometers for securing a fixed surface layer universal hardness. A circumferential length of the transfer fixing roller 21 is set to be larger than a length of transfer paper P with the maximum size (A3 in this example) that can be accommodated in the paper feed cassette 50.

A heating unit including the halogen lamp 22 and the reflecting plate 23 is disposed below the transfer fixing roller 21 shown in FIG. 1. The halogen lamp 22 is disposed so as face the transfer fixing roller 21 via a predetermined gap. The reflecting plate 23 is disposed so as to face a face of the halogen lamp 22 that is positioned on a lower side shown in FIG. 1 and is a non-opposing portion to the transfer fixing roller 21 via a predetermined gap. When the halogen lamp 22 is lighted, a portion of infrared ray emitted according to the lighting that advances toward the transfer fixing roller 21 heats the transfer fixing roller 21 by direct radiation. Infrared ray advancing toward the opposite side of the transfer fixing roller 21 reaches the transfer fixing roller 21 after an advancing direction thereof is reversed by reflection at the reflecting plate 23. Thereby, the reflected infrared ray heats the transfer fixing roller 21 through indirect radiation. Instead of the opposite arrangement of the halogen lamp 22 to the transfer fixing roller 21, the transfer fixing roller 21 can be heated internally by the halogen lamp 22 disposed inside the transfer fixing roller 21. In this case, however, the surface of the transfer fixing roller 21 is heated through the cored bar therein, which results in increase in heat to be accumulated.

A surface temperature sensor (not shown) that detects a surface temperature of the transfer fixing roller 21 utilizing a well-known technique is disposed inside the transfer/fixing apparatus 20 to output a temperature signal to a heater power source circuit (not shown). The heater power source circuit turns ON and OFF of power supplying to the halogen lamp 22 based on the temperature signal from the surface temperature sensor. Thereby, the surface temperature of the transfer fixing roller 21 is maintained in a fixed temperature range.

The transfer fixing roller 21 that is a transfer member is rotationally driven in a counterclockwise direction shown in FIG. 1 by a drive unit (not shown). Thereby, the surface of the transfer fixing roller 21 endlessly moves in the counterclockwise direction shown in FIG. 1. The four-color toner image secondarily transferred from the intermediate transfer belt 11 to the transfer fixing roller 21 gradually softens due to heating according to heat conduction from the transfer fixing roller 21. When the four-color toner image passes through an opposite position to the halogen lamp 22 according to the surface movement of the transfer fixing roller 21, it is further heated by radiation. Thereby, the toner in the four-color toner image is sufficiently softened. At this time, in a temperature distribution in the toner layer, a temperature rises from the side of the roller to the side of the lamp along a thickness of the toner layer. In a first embodiment of the present invention, heating is performed by the halogen lamp 22 such that a temperature on the roller side reaches 80° C., while a temperature on the lamp side reaches about 110 to 120° C. Specifically, since the transfer fixing step is completed at an outlet of the transfer fixing nip (described later), ON and OFF of the halogen lamp 22 is controlled such that an interface between the transfer paper and the toner image at the outlet has a temperature of 110 to 120° C.

The pressurizing roller 24 is arranged on the right side of the transfer fixing roller 21 shown in FIG. 1 so as to be pressurized toward the transfer fixing roller 21, and it rotates to form the transfer fixing nip while contacting with the transfer fixing roller 21. The pressurizing roller 24 serving as a nip forming member includes a cored bar 24*a* made from metal such as iron and an adiabatic layer 24*b* made from a hard material such as porous ceramic or glass and formed on a surface of the cored bar 24*a*. The pressurizing roller 24 also includes an elastic layer 24*c* made from an elastic material such as silicon rubber and formed on a surface of the adiabatic layer 24*b* and a surface layer (not shown) made from a fluorine resin material and formed on a surface of the elastic layer 24*c*. It is preferable that the cored bar 24*a* has a thickness or a diameter equal to or less than 1 millimeter for shortening a temperature-rising time. It is preferable that heat conductivity of the adiabatic layer 24*b* is set equal to or less than 0.1 W/mK and compression strength thereof is set equal to or more than 3 megapascals for achieving both of high adiabatic performance and compression strength enduring load acting on the transfer fixing nip. It is also preferable that an upper limit of a thickness of the elastic layer 24*c* is set to 0.1 millimeter while a lower limit thereof is set to 0.5 millimeter for securing a fixed surface layer universal hardness. It is preferable that a thickness of the surface layer is set equal to or less than 30 micrometers for securing a fixed surface layer universal hardness.

Figure 3:
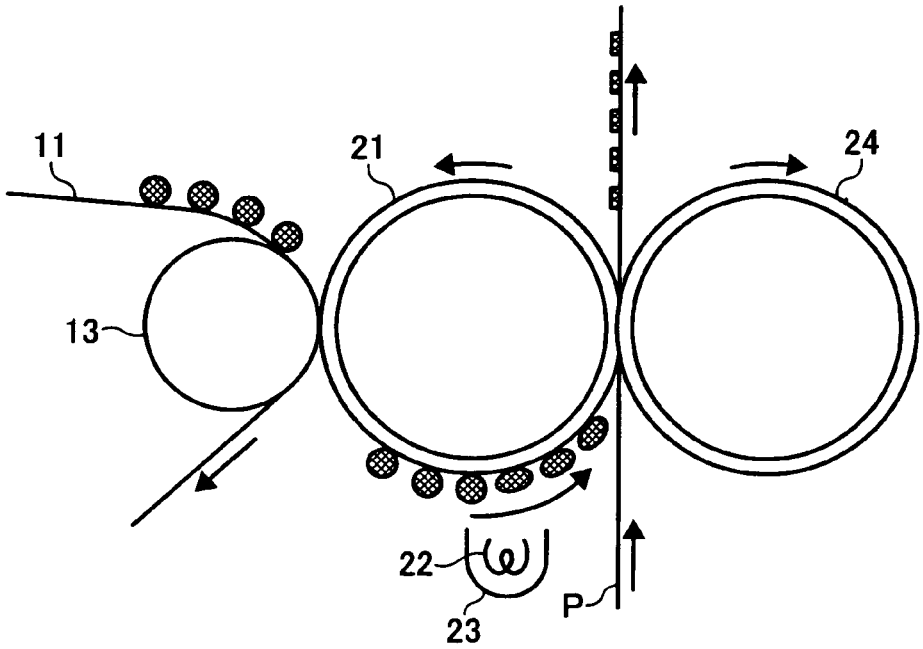
FIG. 3 is a schematic for explaining a second transferring step, a third transferring step, and a fixing step.

As shown in FIG. 3, the four-color toner image softened sufficiently by radiation from the halogen lamp 22 advances into the transfer fixing nip according to the surface movement of the transfer fixing roller 21. On the other hand, a registration roller pair (not shown) disposed below the transfer fixing roller 21 shown in FIG. 1 feeds transfer paper P toward the transfer/fixing apparatus 20 in synchronism with the four-color toner image at the transfer fixing nip.

In the transfer fixing nip, toner contained in the softened four-color toner image causes toner positioned on the surface side of the toner layer to bite in between fibers of the transfer paper P. Thereby, the four-color toner image is fixed on the transfer paper P. The transfer fixing roller 21 and the transfer paper P separate from each other at the outlet of the transfer fixing nip. However, since the transfer paper P has the surface coarser than that of the fixing roller 21, adhesion of the four-color toner image to the transfer paper P is made higher than that to the transfer fixing roller 21. Therefore, the four-color toner image on the transfer fixing roller 21 is thirdly transferred on the transfer paper P. When favorable third transfer cannot be achieved by utilizing only a different in surface coarseness between the paper and the roller, electrostatic transfer is used together with utilization of the different in the third transfer for assisting the third transfer. In this case, when a material including a dispersed conductive material such as a carbon material is used for each layer on the cored bars in the transfer fixing roller 21 and the pressurizing roller 24, the cored bar of one of the rollers 21 and 24 can be grounded while that of the other is applied with transfer bias.

As shown in FIG. 1, after the transfer paper P that has passed through the transfer fixing nip is discharged from the transfer/fixing apparatus 20, it is discharged outside the apparatus via a paper-discharge roller pair (not shown). Remaining post-third transfer toner that has not been transferred on the transfer paper P adheres on the surface of the transfer fixing roller 21 that has passed through the transfer nip. The remaining post-third transfer toner is cleaned by the cleaning roller 25 that rotates while contacting with the transfer fixing roller 21.

In the printer with the basic configuration described above, the visible image forming unit that forms a toner image that is a visible image on the surface of the intermediate transfer belt 11 serving as the image carrier includes the optical write unit 7, the four process units 6Y, 6M, 6C, and 6K, and the intermediate transfer unit 10.

Next, the characteristic configuration of the printer will be explained.

Figure 4:
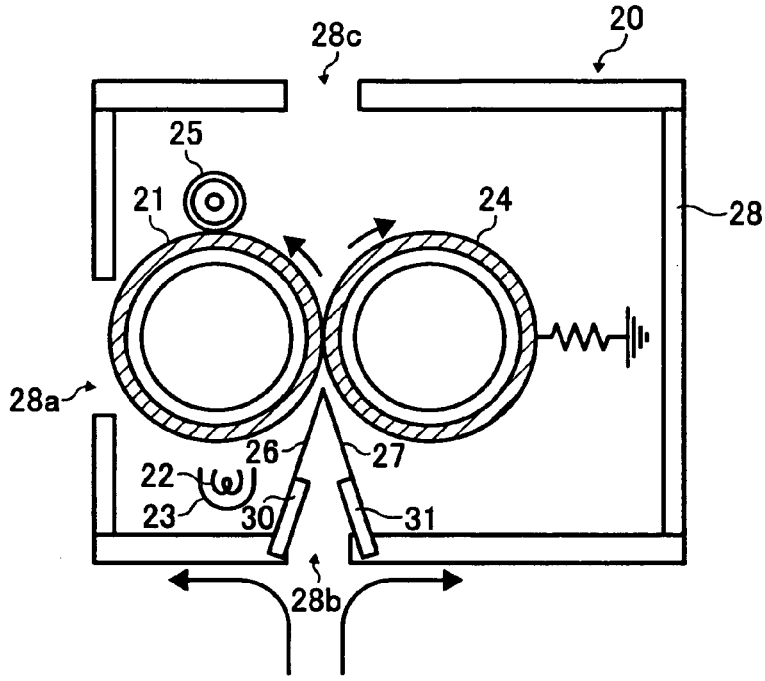
FIG. 4 is an enlarged diagram of a transfer/fixing apparatus shown in FIG. 1.

FIG. 4 is an enlarged diagram where the transfer/fixing apparatus 20 is enlarged. As shown in FIG. 4, the transfer/fixing apparatus 20 includes the casing 28, the transfer fixing roller 21, the pressurizing roller 24, the cleaning roller 25, the heating unit, and the like therein. The casing 28 includes a surface-exposing opening 28*a* for exposing one portion of the circumferential face of the transfer fixing roller 21 to the outside to cause the one portion to contact with the intermediate transfer belt (not shown), a receiving opening 28*b* for receiving transfer paper, and a discharging opening for discharging transfer paper. For example, as a material for making the casing 28, dual plate-members with metallic luster having a low emissivity coupled to each other via a predetermined gap or a foamed adiabatic material can be used. A thin plate including a micro-heat pipe structure used for CPU cooling for a notebook-type personal computer can be used as the material for the casing 28. By using the material with high adiabatic effect, release of heat from the transfer/fixing apparatus 20 can be suppressed.

The receiving opening 28*b* is formed in the casing 28 so as to face downwardly in a vertical direction, and transfer paper fed from the registration roller pair disposed below the transfer/fixing apparatus 20 is received in the casing 28 through the receiving opening 28*b*. A first holder member 30 is fixed on an edge portion of a peripheral edge portion of the receiving opening 28*b* that is positioned on the left side shown in FIG. 4. A second holder member 31 is fixed on an edge portion positioned on the right side shown in FIG. 4.

The first guide plate 26 and the second guide plate 27 are arranged between the transfer fixing nip and the receiving opening 28*b*. The first guide plate 26 and the second guide plate 27 that are positioned such that temperatures thereof are easily raised by radiation from the heating unit include flexible thin plates made from metal a material such as copper or aluminum as base members therefor. A surface of the base member is coated with a surface layer made from a low frictional material such as fluorine resin for making sliding between the guide plate and transfer paper smooth. One end of the first guide plate 26 positioned on the opening side is cantilevered by the first holder member 30, while a free end thereof that is positioned on the nip side is positioned near the transfer fixing nip. One end of the second guide plate 27 positioned on the opening side in an aspect where the second guide plate 27 faces the first guide plate 26 is cantilevered by the second holder member 31, while a free end thereof that is positioned on the nip side is caused to contact with the free end of the first guide plate 26. While the first guide plate 26 and the second guide plate 27 are closing the receiving opening 28*b* by causing the free ends to contact with each other, they guide transfer paper that is a recording sheet and advances in between both of the guide plates toward the transfer fixing nip.

Rising air current easily occurs due to heat generated by the halogen lamp 22 inside the transfer/fixing apparatus 20. While the receiving opening 28*b* facing downwardly in the vertical direction remains opened, external air is actively taken in from the receiving opening 28*b* into the casing 28 to accelerate rising air current. Heated air within the casing 28 is actively released from the surface-exposing opening 28*a* or the discharging opening 28*c* positioned above the receiving opening 28*b* in the vertical direction, so that heat-retention performance is largely reduced. However, as shown in FIG. 4, since the receiving opening 28*b* has been closed according to contact between the free end of the first guide plate 26 and the free end of the second guide plate 27 in the printer, the intake of external air from the receiving opening 28*b* is avoided, as shown with thick arrows shown in FIG. 4. Thereby, generation of rising air current is suppressed in the casing 28, and release of the heat inside can be suppressed. Therefore, a heat loss amount in the transfer/fixing apparatus 20 can be reduced.

A leading edge of transfer paper conveyed while guided by the first guide plate 26 and the second guide plate 27 soon abuts on the contacting portion between both of the plates to advance in between the plates. The transfer paper P pushes the free ends of the first guide plate 26 and the second guide plate 27 to separate them from each other. The respective free ends of the first guide plate 26 and the second guide plate 27 that are then flexible are flexed outwardly in directions in which they do not approach to each other but separate from each other. According to the flexing, both of the guide plates separate from each other and the transfer paper advances in between both of the guide plates, so that the transfer paper is guided toward the transfer fixing nip in the casing 28, as shown in FIG. 1. While an example where both of the first guide plate 26 and the second guide plate 27 displace their free ends according to flexing thereof has been explained in the present embodiment, only one of both of the free ends can be displaced. Displacement of the free end of the guide plate can be performed by rotating the free end around a fixed end of the guide plate instead of flexing of the free end.

Figure 5:
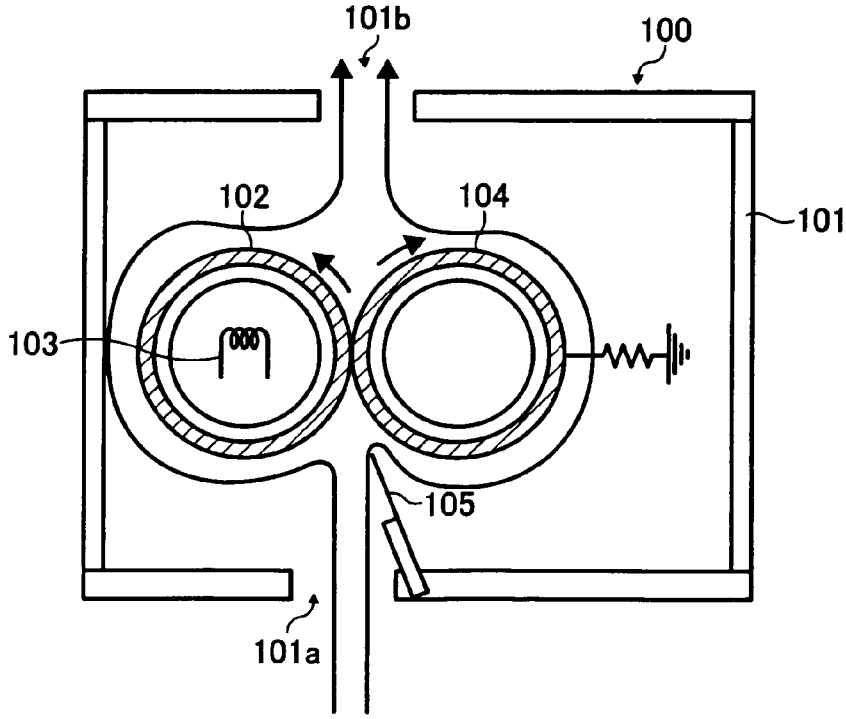
FIG. 5 is a schematic diagram of a former transfer fixing apparatus.

FIG. 5 is a schematic diagram of a former common fixing apparatus 100. The fixing apparatus 100 is for fixing a toner image on transfer paper that has passed through a transfer unit (not shown) that transfers the toner image on the transfer paper. The fixing apparatus 100 includes a fixing roller 102 and a pressurizing roller 104 in a casing 101. The fixing roller 102 includes a halogen lamp 103 therein, and it is rotationally driven in a counterclockwise direction shown in FIG. 5 by a drive unit (not shown). The pressurizing roller 104 is pressed toward the fixing roller 102, and it is rotated in a clockwise direction shown in FIG. 5 while a surface thereof is being caused to contact with the fixing roller 102. The casing 101 includes a receiving opening 101*a* that is provided in a bottom wall of the casing 101, so as to face downwardly in the vertical direction and a discharging opening 101*b* that is provided in an upper wall of the casing 101, so as to face upwardly in the vertical direction. Transfer paper (not shown) received from the receiving opening 101*a* is applied with nip pressure in the course of passage thereof through the transfer nip that is a contacting portion between the fixing roller 102 and the pressurizing roller 104, while being heated by the fixing roller 102. Thereby, after the toner image is fixed on a surface of the transfer paper P, the transfer paper P is discharged outside the casing 101 via the discharging opening 101*b*. A guide plate 105 is disposed between the fixing nip and the receiving opening 101*a*, and it is cantilevered by an edge portion of a peripheral edge of the receiving opening 101*a* that is positioned on the right side shown in FIG. 5.

The guide plate 105 is thus fixed on the edge portion of the receiving opening 101*a* positioned on the right side shown in FIG. 5, however, no guide plate is fixed on an edge portion thereof positioned on the left side shown in FIG. 5. The reason for this configuration is described below. That is, in the former fixing apparatus 100, transfer paper transferred with a toner image by a transfer unit (not shown) is received from the receiving opening 101*a*. However, an unfixed toner image is carried on an opposite face of the transfer paper to the fixing roller 102. If a guide plate is fixed at an edge portion of the receiving opening on the left side shown in FIG. 5, the unfixed toner image on the transfer paper rubs against the guide plate. Therefore, in the illustrated fixing apparatus 100, no guide plate is provided at the edge portion on the left side shown in FIG. 5. Further, a width of the receiving opening 101*a* in a horizontal direction shown in FIG. 5 is made large, for example several millimeters, such that the unfixed toner image on the transfer paper does not rub against the edge portion of the receiving opening 101*a* on the left side shown in FIG. 5. With this configuration, external air is actively taken in from the receiving opening 101*a* according to rising air current generated in the casing due to heat generation of the halogen lamp 103, as shown by thick arrows shown in FIG. 5. Simultaneously, since hot air is actively released from the discharging opening 101*b* to the outside of the casing, a heat loss amount in the fixing apparatus 100 is increased considerably.

On the other hand, in the transfer/fixing apparatus 20 in the printer, as shown in FIG. 1, since transfer paper P that does not carry a toner image thereon is received in the casing 28, even if both faces of the transfer paper P are slid on the guide members, a problem such as disturbance of the toner image does not occur. As shown in FIG. 4, therefore, the guide members are provided on edge portions of the peripheral portion of the receiving opening 28*b* that are positioned at the left side and the right side shown in FIG. 5 corresponding to a thickness direction of the transfer paper P, so that one face and the other face of the transfer paper P are caused to slide on the guide plates. The receiving opening 28*b* is closed by the two guide plates (the first guide plate 26 and the second guide plate 27), so that reception of external air from the receiving opening 28*b* is blocked off.

As shown in FIG. 1, the contacting portion between the first guide plate 26 and the second guide plate 27 is positioned in a region positioned at an upstream side of the transfer nip in surface moving directions of both of the rollers where the transfer fixing roller serving as the transfer roller and the pressurizing roller 24 serving as the nip forming roller contact with each other and in a region where the circumferential faces of both of the rollers face each other. With this configuration, the transfer paper P positioned between both of the rollers is guided near the transfer fixing nip by the first guide plate 26 and the second guide plate 27 so that accurate positioning of the transfer paper P is performed just in front of the nip. Thereby, an image with high quality that does not include positional deviation of the image can be formed.

As described above, in the transfer fixing nip, when both of a heating-transfer system and an electrostatic transfer system are used, one of the transfer fixing roller 21 and the pressurizing roller 24 is grounded while the other thereof is applied with third transfer bias. With this configuration, as shown in FIG. 1, when a leading edge of transfer paper P is sandwiched in the transfer fixing nip, a trailing end of the transfer paper P is sandwiched between the first guide plate 26 and the second guide plate 27. Thereby, the transfer fixing nip, and the first guide plate 26 and the second guide plate 27 are bridged by the transfer paper P. At. this time, when an electric resistance value of the transfer paper P is considerably low due to moisture absorption, transfer current leaks to the first guide plate 26 or the second guide plate 27 via the transfer paper P. In the transfer fixing nip, when both of the heating-transfer system and the electrostatic transfer system are used, plates with a surface layer made from insulating material are used as the first guide plate 26 and the second guide plate 27. Thereby, the leakage of current to both of the guide plates can be prevented.

In the printer, plates having contacting faces with transfer paper P whose sizes in a direction perpendicular to the sheet conveying direction, namely, sizes thereof in a direction perpendicular to the figure paper plane, satisfy the following condition are used as the first guide plate 26 and the second guide plate 27. That is, the condition is that the sizes are larger than a size of transfer paper P with the maximum size (A3 size in the embodiment) that can be accommodated in the paper feed cassette 50 in a direction perpendicular to the conveying direction. With this configuration, even if transfer paper P with the maximum size is used, the transfer paper P can be reliably guided toward the transfer fixing nip by the first guide plate 26 and the second guide plate 27.

With regard to a layout in the printer, it is preferable that the discharging opening 28*c* of the casing 28 faces upwardly in the vertical direction, as shown in FIG. 1. With this configuration, dew condensation can be suppressed by releasing excessive heat remaining in an upper portion of the casing 28 from the discharging opening 28*c* little by little. Thereby, lowering of image quality due to adhesion of water drops on transfer paper P can be suppressed. It is necessary to convey transfer paper P within the transfer fixing nip from a lower side toward an upper side in the vertical direction to direct the discharging opening 28*c* for discharging transfer paper P to the outside of the casing 28 upwardly in the vertical direction.

It has been known that a shape of toner particles forming a toner image is related to transfer performance (transfer efficiency or maintenance of image shape) of a toner image from the intermediate transfer belt 11 to the transfer fixing roller 21. Toner where the Wadell's practical sphericity $\phi$ of the toner particle is equal to or more than 0.8 is favorable in transfer performance. Therefore, toner where the Wadell's practical sphericity $\phi$ of the toner particle is equal to or more than 0.8 is used as the toner in the present embodiment. The Wadell's practical sphericity $\phi$ can be measured utilizing a method disclosed in Japanese Patent Application Laid-open No. H09-258474. Specifically, the Wadell's practical sphericity $\phi$ can be obtained by using such a relational equation as "$\phi$=(a diameter L1 of a circle equal to a particle projection area)/(a diameter L2 of a circle circumscribed on a particle projection image). Powdered toner is placed on a slide glass in a proper amount, it is observed by a microscope of 500 magnifications, and the above-described L1 and L2 of any 100 toner particles in the powdered toner are measured, so that the Wadell's practical sphericity $\phi$ is obtained. Toner powder where an average value of the Wadell's practical sphericities $\phi$ of 100 toner particles is equal to or more than 0.8 is used.

The example that plates which are flexible and have free ends caused to contact with each other are used the first guide plate 26 and the second guide plate 27 has been explained. However, plates which are non-flexible and have free ends facing each other via a gap equal to or less than 5 millimeters can be used as the guide plates.

In the printer, a covering member that covers an inlet of the transfer fixing nip is formed by a bottom plate of the casing 28 of the transfer/fixing apparatus 20, and the first guide plate 26 and the second guide plate 27 that are fixed to the bottom plate. A gap between the first guide plate 26 and the second guide plate 27 functions as an opening for guiding transfer paper P into the transfer fixing nip.

Figure 6:
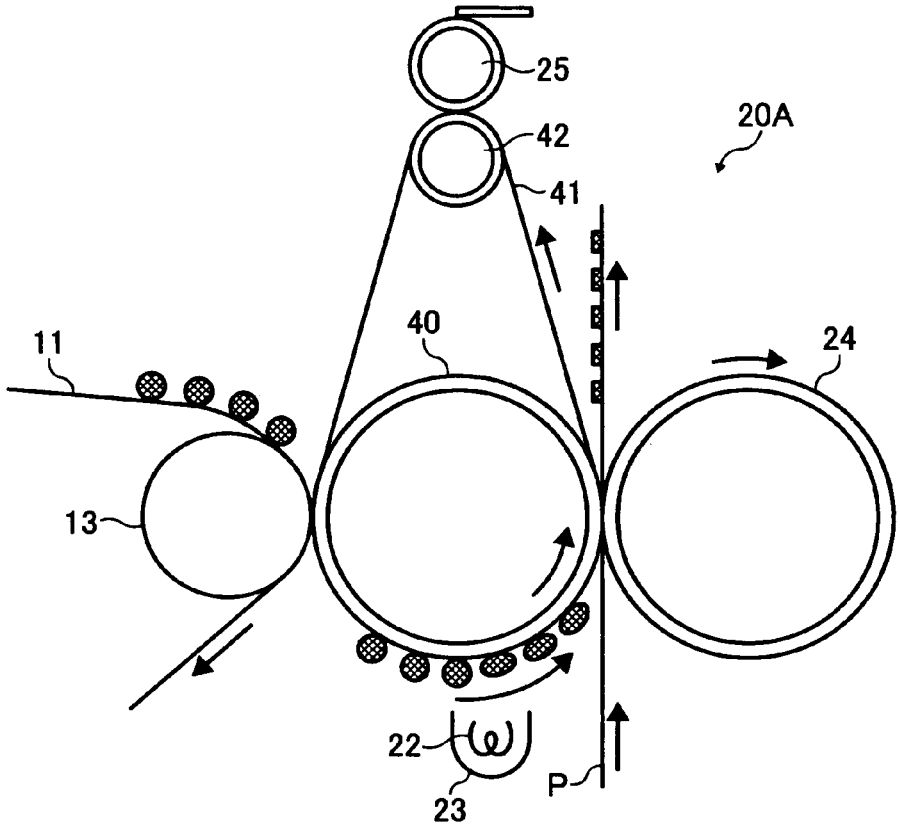
FIG. 6 is an enlarged diagram of relevant parts in a first modified transfer fixing apparatus according to the first embodiment.

FIG. 6 is an enlarged diagram of relevant parts of a first modified apparatus 20A in the printer according to the first embodiment. The first modified apparatus 20A includes a drive roller 40, a transfer fixing belt 41, a backup roller 42, and the like instead of the transfer fixing roller 21 shown in FIG. 1. The transfer fixing belt 41 serving as a transfer member is endlessly moved in a counterclockwise direction shown in FIG. 6 by the drive roller 40 that is rotationally driven by a drive unit (not shown) in the counterclockwise direction shown in FIG. 6, while being spanned between the drive roller 40 and the backup roller 42 arranged inside a loop of the transfer fixing belt 41. The intermediate transfer belt 11 contacts with a region on the left side shown in FIG. 6 included in a turning portion of the transfer fixing belt 41 on the drive roller 40 to form a second transfer nip. The pressurizing roller 24 contacts with a region on the right side shown in FIG. 6 included in a turning portion of the transfer fixing belt 41 on the drive roller 40 to form the second transfer nip. A four-color toner image secondarily transferred from the intermediate transfer belt 11 to the transfer fixing belt 41 at the second transfer nip is thirdly transferred on transfer paper P at the transfer fixing nip and it is fixed on a paper face thereof. Remaining post-third transfer toner adhering on the front face of the transfer fixing belt 41 that has passed through the transfer fixing nip is removed by a cleaning roller 25 sandwiching the transfer fixing belt 41 between the same and the backup roller 42.

In the first modified apparatus 20A thus configured, a movement distance of the transfer member (the transfer fixing roller 21 or the transfer fixing belt 41) from an outlet of the transfer fixing nip to the second transfer nip is elongated by using the transfer fixing belt instead of the transfer fixing roller 21. Thereby, the transfer member is advanced into the second transfer nip after being further cooled. Heat conduction from the transfer member to the intermediate transfer belt 11 is suppressed so that thermal degradation of the intermediate transfer belt 11 can be suppressed. When the transfer fixing roller 21 is used, heat from the halogen lamp 22 is transferred to the cored bar in the roller, however, when a transfer fixing belt unit is used, heat conduction to the cored bar can be suppressed. Thereby, an accumulated heat quality is reduced so that energy efficiency can be raised.

Figure 7:
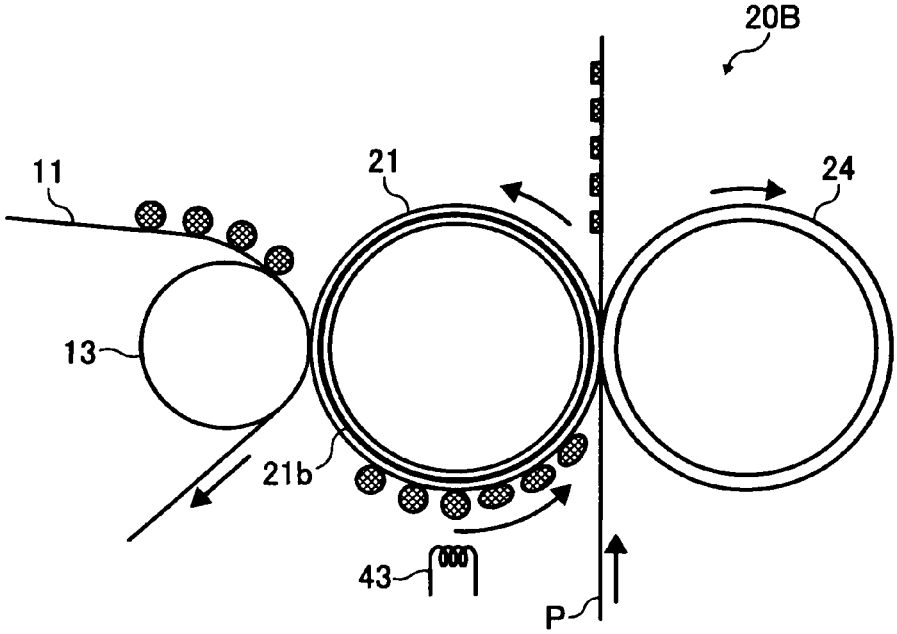
FIG. 7 is an enlarged diagram of relevant parts in a second modified transfer/fixing apparatus according to the first embodiment.

FIG. 7 is an enlarged diagram of relevant parts of a second modified apparatus 20B in the printer according to the first embodiment. The second modified apparatus 20B includes an electromagnetic induction apparatus as the heat-generating source for heating a four-color toner image secondly transferred on a surface of transfer paper instead of the halogen lamp 22. The electromagnetic induction apparatus includes a heat-generating layer 21*d* made from silver or the like and provided under a surface layer of the transfer fixing roller 21, an induction coil 43 disposed so as to face the transfer fixing roller 21 via a predetermined gap, and a core (not shown). When the induction coil is excited, the core (not shown) generates magnetic field. Eddy current is generated in the heat-generating layer 21*d* of the transfer fixing roller 21 so that the heat-generating layer 21*d* generates heat. Thereby, the surface layer of the transfer fixing roller 21 and a four-color toner image carried thereon are heated. With this configuration, by providing the heat-generating layer 21*d* functioning as the heat-generating source near the surface of the transfer fixing roller 21, the transfer fixing processing can be performed with energy lower than that required in the radiation system.

Figure 8:
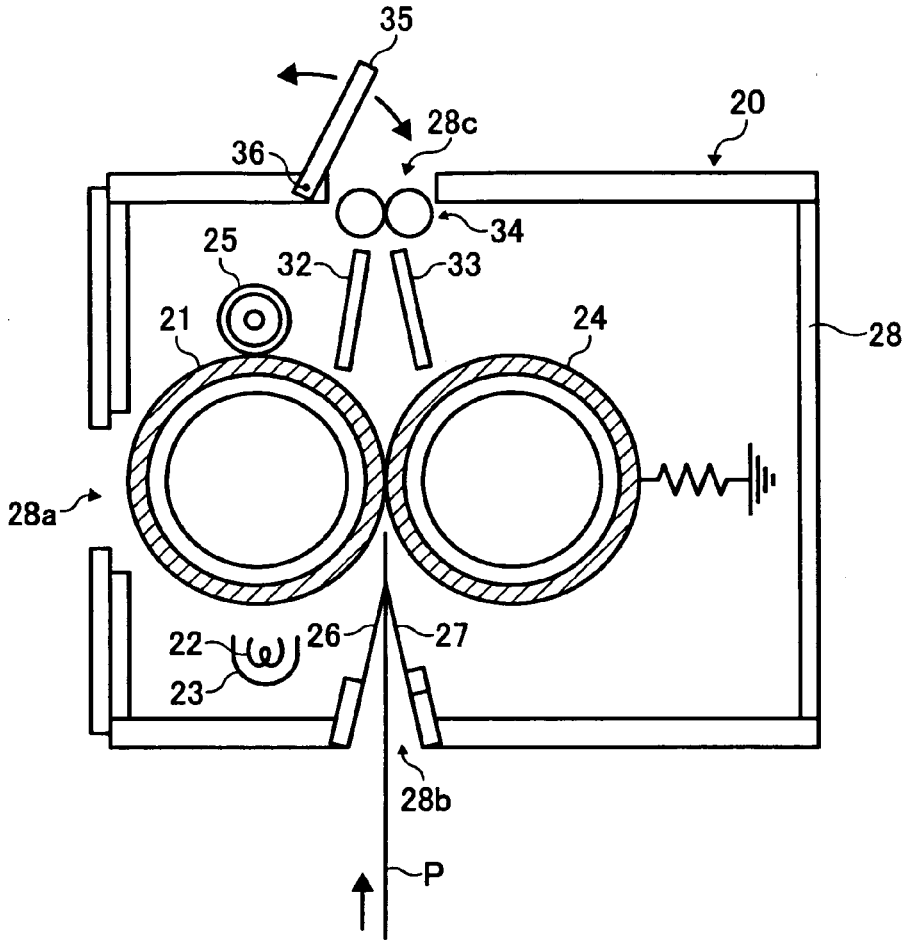
FIG. 8 is an enlarged diagram of relevant parts in a third modified transfer/fixing apparatus according to the first embodiment.

FIG. 8 is an enlarged diagram of relevant parts of a third modified apparatus 20C in the printer according to the first embodiment. The third modified apparatus 20C includes a first paper discharge guide-plate 32 and a second paper discharge guide-plate 33 that are provided so as to face each other between an outlet of the transfer fixing nip and the discharging opening 28*c* of the casing 28. Transfer paper P going out of the transfer fixing nip advances in between the paper discharge guide plates to be guided toward the discharging opening 28*c*. A paper discharge roll pair 34 is disposed between the first paper discharge guide-plate 32 and the second paper discharge guide-plate 33, and the discharging opening 28*c*, so that the transfer paper P reaches the discharging opening 28*c* through between rolls in the discharge roll pair 34.

A shutter member 35 that opens and closes the discharging opening 28*c* according to rotation thereof around a rotation shaft 36 is provided on an upper wall of the casing 28. The rotation shaft 36 is rotated via drive transmission (not shown) including a gear and the like, so that the shutter member 35 is rotated to open or close the discharging opening 28*c*. One of the three openings 28*a*, 28*b*, and 28*c* provided in the casing 28 that releases heat inside the casing 28 most easily is the discharging opening 28*c* provided in the upper wall of the casing 28. Therefore, the shutter member 35 is provided to suppress wasteful leakage hot air from the discharging opening 28*c* as much as possible. Thereby, only when the transfer paper P is discharged from the discharging opening 28*c*, the discharging opening 28*c* is opened, or the discharging opening 28*c* is continuously opened during continuous paper discharging in a continuous printing operation, so that heat loss can be largely reduced. When heat remains excessively due to closing of the shutter member 35, control for opening the shutter member 35 periodically at a timing except for paper discharging can be performed by a shutter operation control unit. Thereby, dew condensation in the casing 28 due to excessive remaining of heat can be avoided. The shutter member 35 can adopt a configuration where opening and closing operations are performed according to slide thereof instead of the configuration where the operations are performed according to rotation thereof.

Figure 9:
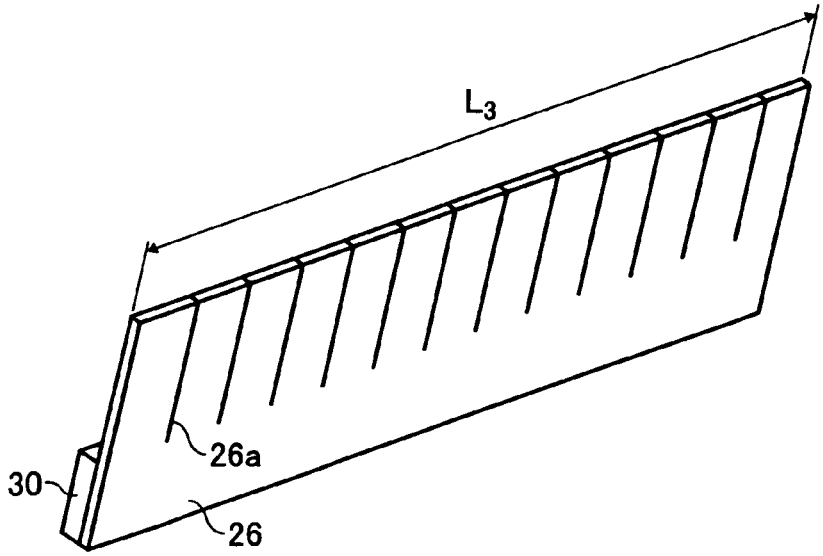
FIG. 9 is a schematic of a first guide plate in a fourth modified transfer/fixing apparatus according to the first embodiment.

FIG. 9 is a schematic of a first guide plate in a fourth modified transfer/fixing apparatus according to the first embodiment. In the fourth modified apparatus, a free end of the first guide plate 26 that is not fixed to the first holder member 30 is formed with a plurality of slits 26*a* arranged in a direction perpendicular to the paper conveying direction at a predetermined pitch to divide the free end into many pieces in the direction perpendicular to the paper conveying direction. The free end is divided into the many pieces arranged in the direction perpendicular to the paper conveying direction by the slits 26*a*, so that the respective pieces can be flexed independently. A length L3 of the contacting portion of the first guide plate 26 with transfer paper P in the direction perpendicular to the paper conveying direction is set to be longer than a width of transfer paper with the maximum size that can be accommodated in the paper feed cassette 50 previously shown in FIG. 1. When transfer paper with the maximum size is fed into the transfer/fixing apparatus, all the divided pieces in the free end of the first guide plate 26 are flexed according to contact with the transfer paper, so that the receiving opening (not shown) is opened over its entire width. On the other hand, when transfer paper with a size smaller than the maximum size is fed, only some of the divided pieces in the free end of the first guide plate 26 are flexed according to contact with the transfer paper. The divided pieces that do not contact with the transfer paper remains contacting with the second guide plate (not shown) without being flexed. With this configuration, when transfer paper with a size smaller than the maximum size is fed into the transfer/fixing apparatus, a problem such that a region in the region of the free end of the first guide member that does not contact with the transfer paper is also flexed so that release of hot air or intake of external air from the receiving opening caused by formation of a slight gap between the free end and the second guide plate can be avoided. The free end of the second guide plate 27 can be divided instead of that of the first guide plate 26 or both of the guide plates have a slit structure.

Figure 10:
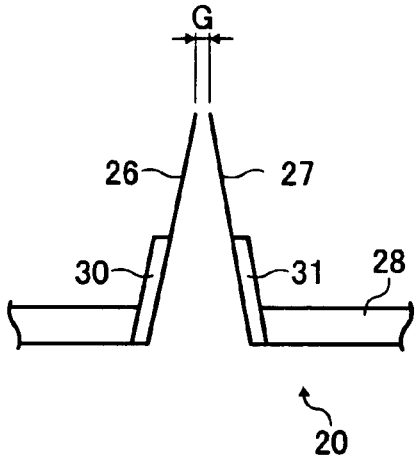
FIG. 10 is an enlarged partial diagram of an area near a receiving opening of a transfer/fixing apparatus in a printer according to a second embodiment of the present invention.

Next, a printer according to a second embodiment of the present invention will be explained. A basic configuration of the printer according to the second embodiment is similar to that of the printer according to the first embodiment unless otherwise specified, and explanation thereof is omitted. As shown in FIG. 10 and the following diagrams, members or apparatus that function similarly to those in the printer according to the first embodiment are attached with like reference numerals as those used in the explanation of the printer according to the first embodiment.

FIG. 10 is an enlarged diagram of a portion of the transfer/fixing apparatus 20 near a receiving opening 28*b* in the printer. A configuration of the transfer/fixing apparatus 20 in the printer is substantially identical to that in the printer according to the first embodiment. However, both of the printers are different from each other in that the free ends of the first guide plate 26 and the second guide plate 27 are caused to contact with each other in the printer according to the first embodiment, whereas distal ends of the free ends of both of the guide plates face each other via a minute gap G in the printer according to the second embodiment. A value of the minute gap G is set equal to or less than 250 micrometers, and it is a thickness less than that of cardboard generally used in a printer. With this configuration, while transfer paper is not received in the transfer/fixing apparatus 20, the receiving opening 28*b* is only opened with a minute width equal to or less than 250 micrometers, so that heat loss in the transfer/fixing apparatus 20 can be suppressed by suppressing release of hot air or intake of external air from the receiving opening 28*b*. When transfer paper is received, the receiving opening 28*b* is opened up to a thickness of the transfer paper by displacement due to flexing of the free end(s) of the first guide plate 26 or the second guide plate 27, so that the transfer paper can be received in the casing 28. The minute gap G can be set equal to or less than 100 micrometers, which corresponds to a common thickness of standard paper.

Figure 20:
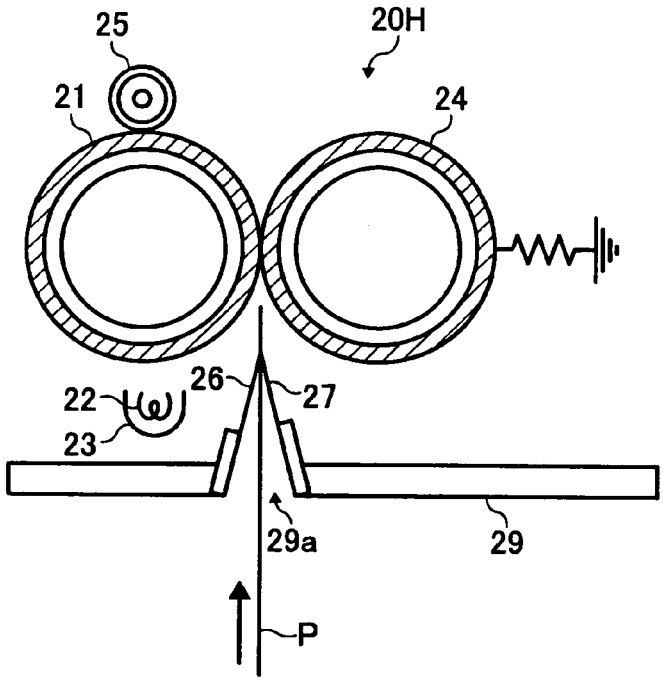
FIG. 20 is an enlarged diagram of the first modified transfer/fixing apparatus in the printer according to the second embodiment.

FIG. 20 is an enlarged diagram of the first modified transfer/fixing apparatus in the printer according to the second embodiment. The first modified apparatus 20H does not include a casing serving as a housing including the various rollers 21, 24, and 25 and the halogen lamp 22, where the rollers and the lamp are exposed in the printer. However, the shielding plate 29 for shielding the transfer fixing nip and a registration roller pair (not shown in FIG. 20, but corresponds to 52 shown in FIG. 1) positioned below the nip is provided between the nip and the pair. The opening 29*a* is provided at a portion of the shielding plate 29 positioned just below the transfer fixing nip. The first guide plate 26 and the second guide plate 27 are cantilevered by two inner walls of the opening 29*a* opposed to each other. A gap between free ends of the first guide plate 26 and the second guide plate 27 is set equal to or less than 5 millimeters. Note that 0 millimeter is also included in the range of equal to or less than 5 millimeters.

With this configuration, by setting the gap between the first guide plate 26 and the second guide plate 27 to a small size such as equal to or less than 5 millimeters, which has not been set, an advancing amount to the opening 29*a* of air current occurring according to conveyance of transfer paper at an upstream side of the shielding plate 29 that is a covering member in the transfer paper conveying direction can be reduced. Thereby, a problem such that hot air remaining around the halogen lamp 22 is blown away by air current that advances from the opening 29*a* is avoided, so that a heat loss amount can be reduced.

Figure 11:
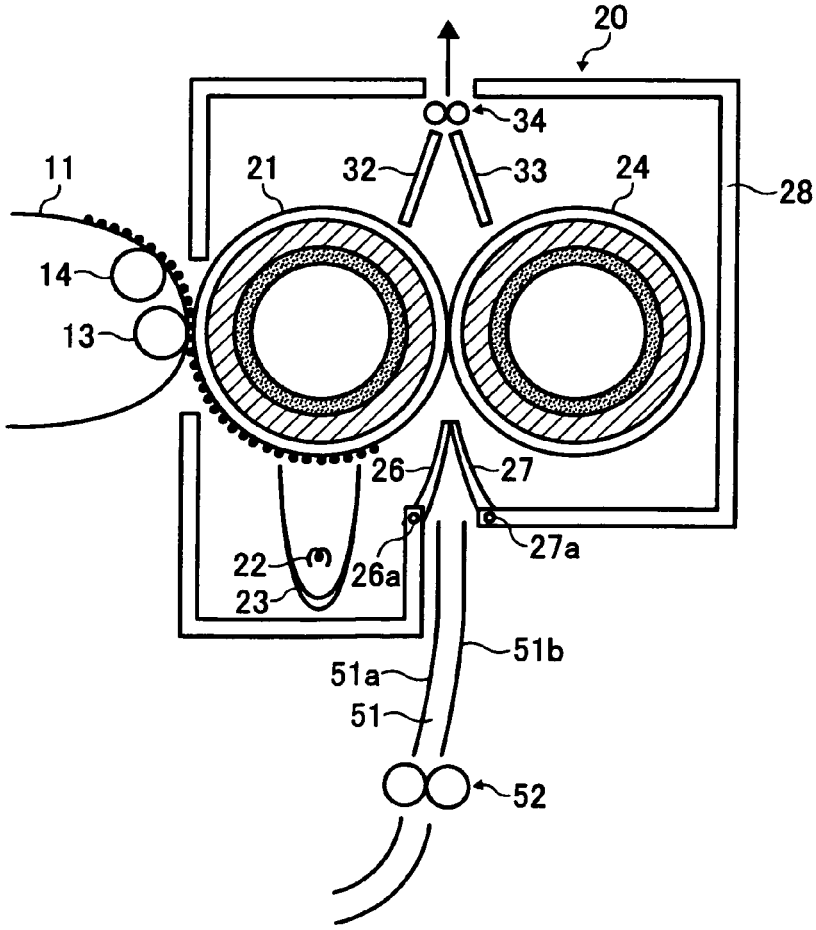
FIG. 11 is a schematic diagram of a transfer/fixing apparatus in a printer according to a third embodiment of the present invention.

Next, a printer a according to a third embodiment of the present invention will be explained. A basic configuration of the printer according to the third embodiment is similar to that of the printer according to the first embodiment unless otherwise specified, and explanation thereof is omitted. As shown in FIG. 11 and the following diagrams, members or apparatus that function similarly to those in the printer according to the first embodiment are attached with like reference numerals as those used in the explanation of the printer according to the first embodiment.

FIG. 11 is a schematic diagram of a transfer/fixing apparatus 20 in the printer. The illustrated transfer/fixing apparatus 20 is configured substantially identical to the third modified apparatus 20C previously shown in FIG. 8. However, the transfer/fixing apparatus 20 is different from the third modified apparatus 20C shown in FIG. 8 in that a paper feed path for conveying transfer paper fed from the registration roller pair 52 toward the transfer/fixing apparatus 20 is configured to feed the transfer paper toward the first guide plate 26 of two guide plates cantilevered at a peripheral edge of the receiving opening of the transfer/fixing apparatus 20 in the former. The transfer/fixing apparatus 20 is also different from the third modified apparatus 20C shown in FIG. 8 in that free ends of two guide plates 26 and 27 are displaced according to rotation of the guide plates in the former.

Since the first guide plate 26 is positioned near a heating unit including the halogen lamp 22, the reflecting plate 23, and the like, the plate is heated by the heating unit. A temperature of the first guide plate 26 varies according to a distance from the heating unit to the first guide plate 26, a shape of the reflecting plate 23, and the like, and it can reach about 100° C. The paper feed path 51 is configured to feed transfer paper toward the first guide plate 26 thus heated by the heating unit. Specifically, the paper feed path 51 is for causing transfer paper to pass between a first path plate 51*a* disposed on the left side shown in FIG. 11 and a second path plate 51*b* disposed on the right side shown in FIG. 11. However, the second path plate 51*b* projects to extend beyond the first path plate 51*a* at their ends in the paper feed direction, and the projecting portion of the second path plate 51*b* is bent toward the first path plate 51*a*. Accordingly, the transfer paper contacts with the end of the second path plate 51*b* at the end portion of the paper feed path to be fed toward the first guide plate 26, so that the transfer paper is pushed on the first guide plate 26 at an upstream side of the contacting portion between the first guide plate 26 and the second guide plate 27. With this configuration, transfer paper can be pushed on the first guide plate 26 to be preheated prior to advancing of the transfer paper to the transfer/fixing apparatus 20. A temperature of the transfer paper is raised utilizing accumulated heat in the first guide plate 26 according to the preheating, which is different from the technique where the accumulated heat in the first guide plate 26 is discharged in the atmosphere wastefully. Thereby, a heating amount to the transfer fixing roller 21 applied from the heating unit can be reduced to suppress heat loss by reducing heat quality required for application to the transfer paper at the transfer fixing nip. According to the experiment conducted by the present inventors, the surface temperature of the transfer fixing roller 21 had to be controlled to 150° C. when preheating was not performed by the first guide plate 26 under a condition such that transfer paper was conveyed at a linear speed of 300 mm/sec. On the other hand, when preheating was performed by the first guide plate 26, a toner image was favorably transferred and fixed on transfer paper, even if the surface temperature of the transfer fixing roller 21 was lowered to 140° C. At this time, a temperature of the first guide plate 26 was about 100° C. If the temperature of the first guide plate 26 is not raised sufficiently by the heating unit, the reflecting plate 23 and the first guide plate 26 should be connected via a high heat conductivity material such as aluminum, or direct radiation should be performed from the halogen lamp 22 to the first guide plate 26 via an opening formed in the reflecting plate 23.

The first guide plate 26 and the second guide plate 27 are each formed by coating a thin plate made from metal having high heat conductivity such as copper or aluminum with heat-stable resin such as polyimide. By thickening the first guide plate according to application of the resin coating, a heat accumulation amount of the first guide plate 26 is increased so that it is made possible to utilize the accumulated heat quality for preheating efficiently. However, flexibility of the guide plate cannot be developed sufficiently due to its thickening. Therefore, the first guide plate 26 and the second guide plate 27 are attached to be rotatable about rotation shafts 26*a* and 27*a*, and the free ends of both of the plates are biased by forces such as spring forces such that the plates approach to each other. When transfer paper advances in between both of the plates, the free ends of the plates are rotated in directions opposed to biasing directions of the spring forces. Opening and closing of the receiving opening according to displacement of the free ends can be accomplished.

When both of the heating-transfer system and the electrostatic transfer system are used in the transfer fixing nip, it is preferable that plates formed with a surface layer made from insulating material are used as the first guide plate 26 and the second guide plate 27 so that the leakage of current to the guide plates is prevented. It is preferable that the surface layer of the first guide plate 26 is formed from material with low frictional coefficient regardless of simultaneous use of the electrostatic transfer system. Thereby, stacking of transfer paper on the first guide plate 26 can be avoided by smoothly sliding a leading edge of the transfer paper pushed on the first guide plate 26 in the paper feed path 51 on a surface of the first guide plate 26.

Figure 12:
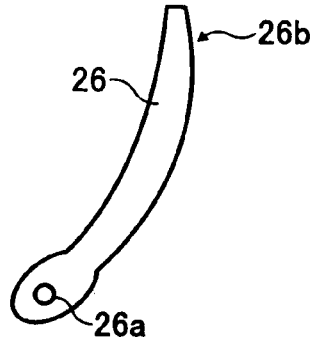
FIG. 12 is an enlarged side view of a first guide plate shown in FIG. 11.

FIG. 12 is an enlarged side view of a first guide plate shown in FIG. 11. As shown in FIG. 12, the first guide plate 26 is formed to have a curved face extending from the receiving opening (not shown) toward the transfer fixing nip in an arc shape. Stacking of a leading edge of transfer paper on the first guide plate 26 is further avoided.

Figure 13:
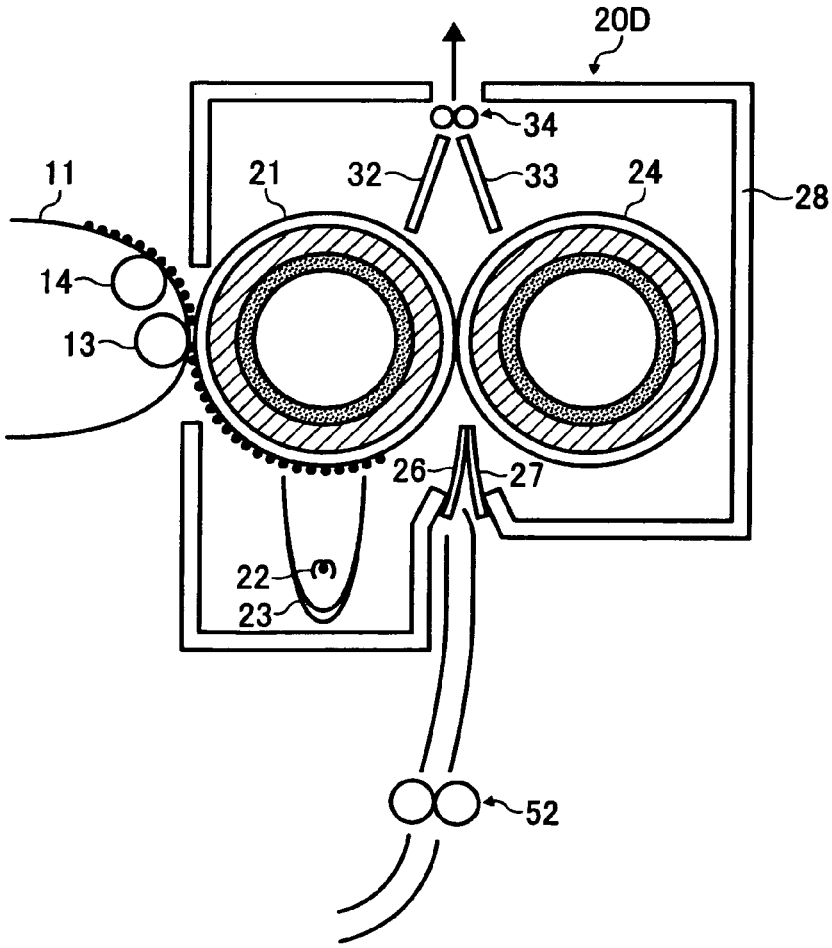
FIG. 13 is a schematic diagram of a first modified transfer/fixing apparatus according to the third embodiment.

FIG. 13 is a schematic diagram of a first modified apparatus 20D of the transfer/fixing apparatus 20 of the printer according to the third embodiment. In the first modified apparatus 20D, plates that are thin and develop flexibility are used as the first guide plate 26 and the second guide plate 27. With this configuration, even if a mechanism for rotating both of the guide plates provided in such an apparatus as previously shown in FIG. 11 is not provided, the receiving opening of the casing 28 can be opened due to flexing of the free ends of both of the guide plates according to contact with transfer paper. However, the heat accumulation amount of the first guide plate 26 is less than that in the apparatus shown in FIG. 11.

Figure 14:
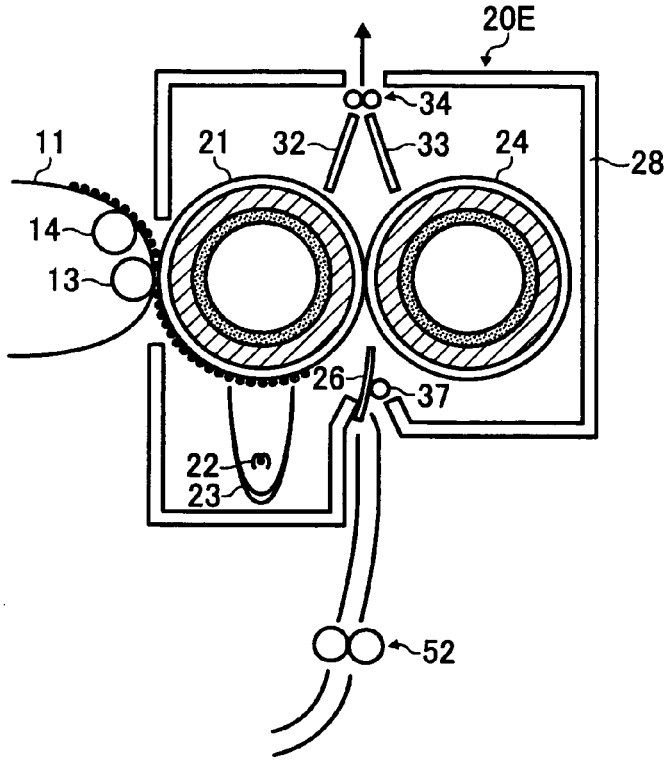
FIG. 14 is a schematic diagram of a second modified transfer/fixing apparatus according to the third embodiment.

FIG. 14 is a schematic diagram of a second modified apparatus 20E of the transfer/fixing apparatus 20 of the printer according to the third embodiment. The second modified apparatus 20E includes an inlet guide roll 37 formed by coating a cored bar with an elastic layer made from rubber instead of the second guide plate 27, where the inlet guide roll 37 rotates while a circumferential face thereof is contacting with the first guide plate 26. A plate that is thin and flexible is used as the first guide plate 26. The inlet guide roll 37 is rotatably supported at a peripheral edge of the receiving opening and it is biased toward the first guide plate 26 by weak force such as spring force. The receiving opening is closed by contact between the first guide plate 26 and the inlet guide roll 37, however, when transfer paper advances in the contact portion between both of the plate and the roll, the free end of the first guide plate 26 is flexed so that the receiving opening is opened up to a thickness of the transfer paper. Thereby, the transfer paper is received in the casing 28. Prior to the reception, it is needless to say that the transfer paper is preheated by contact thereof with the first guide plate 26.

Figure 15:
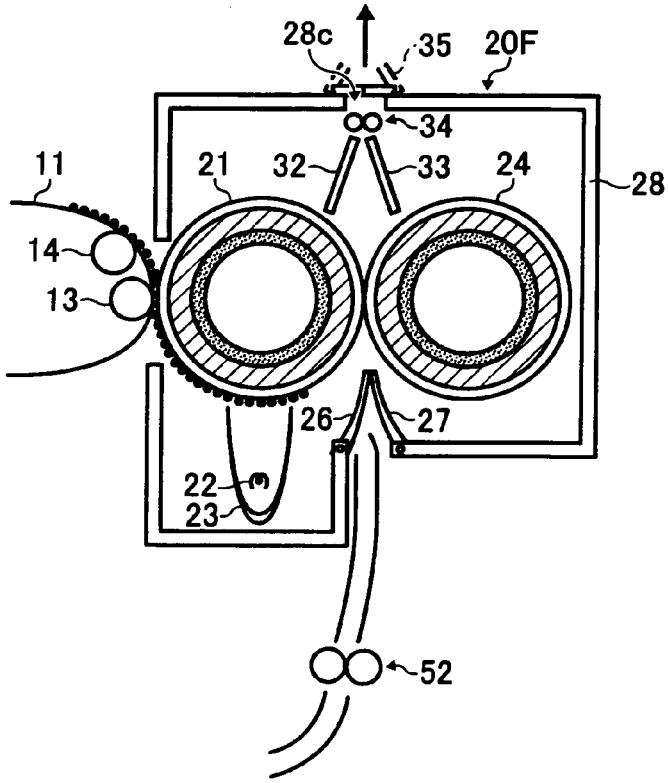
FIG. 15 is a schematic diagram of a third modified transfer/fixing apparatus according to the third embodiment.

FIG. 15 is a schematic diagram of a third modified apparatus 20F of the transfer/fixing apparatus 20 in the printer according to the third embodiment. The third modified apparatus 20F is different from the transfer/fixing apparatus 20 shown in FIG. 11 in that the shutter member 35 for opening and closing the discharging opening of the casing is provided in an upper wall of the casing 28 in the former. Only when transfer paper P is discharged from the discharging opening 28*c*, the discharging opening 28*c* is opened by the shutter member 35, or the paper discharging opening is continuously opened thereby during continuous paper discharging in a continuous printing operation, so that heat loss can be largely reduced.

Figure 16:
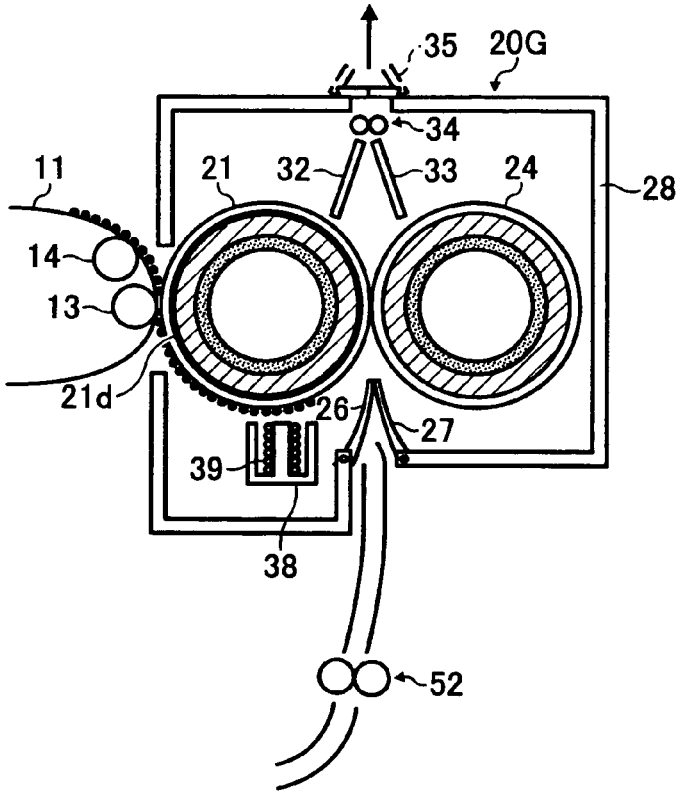
FIG. 16 is a schematic diagram of a fourth modified transfer/fixing apparatus according to the third embodiment.

FIG. 16 is a schematic diagram of a fourth modified apparatus 20G of the transfer/fixing apparatus 20 of the printer according to the third embodiment. The fourth modified apparatus 20G includes a heating unit of an electromagnetic induction system instead of the heating unit of the radiation and reflection type. The heating unit includes the heat-generating layer 21*d* provided between the elastic layer and the adiabatic layer of the transfer fixing roller 21, an induction coil 39 and a core 38 for the coil that are disposed to face the transfer fixing roller 21 via a predetermined gap. The heat-generating layer 21*d* is formed of a metal thin layer made from substance such as ferromagnetic substance. When the induction coil 39 is excited, magnetism is generated from the core 38. Eddy current is induced in the heat-generating layer 21*d* so that the heat-generating layer 21*d* generates heat. It is preferable that a thickness of the heat-generating layer 21*d* is set in a range of about 200 to 1000 micrometers in view of the balance between calorific value and heat capacity. Thereby, the surface of the transfer fixing roller 21 can be heated further efficiently and size reduction of the heating unit can be achieved. The first guide plate 26 is disposed near the core 38, and it is heated by Joule heat generated from the induction coil 39. If a heat-generating layer is provided also on the first guide plate 26, the first guide plate 26 can be heated by magnetism generated from the core 38.

Figure 17:
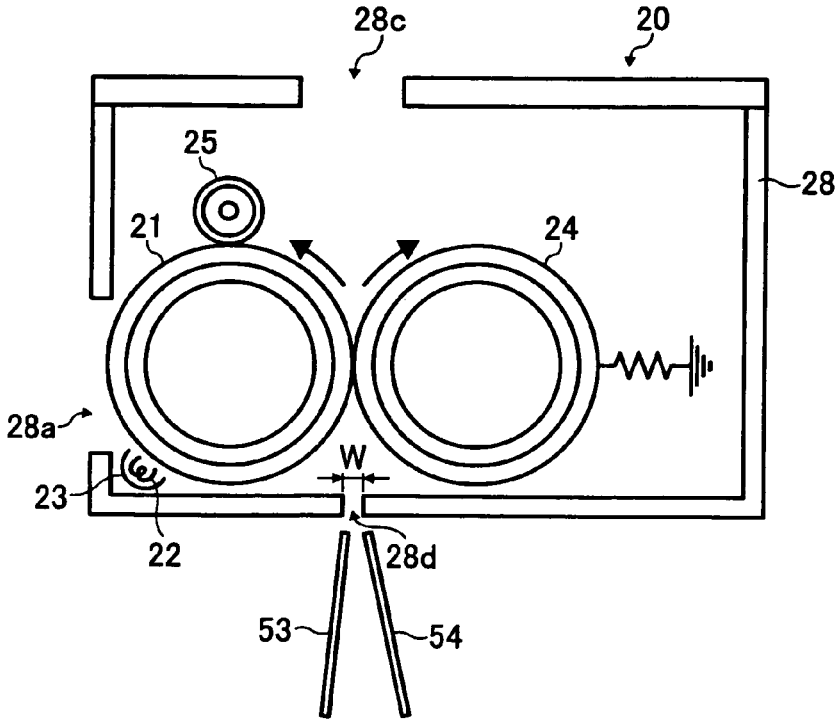
FIG. 17 is a schematic diagram of a transfer/fixing apparatus of a printer according to a fourth embodiment of the present invention.

A printer according to a fourth embodiment of the present invention will be explained next. A basic configuration of the printer according to the fourth embodiment is similar to that of the printer according to the first embodiment unless otherwise specified, and explanation thereof is omitted. As shown in FIG. 17 and the following diagrams, members or apparatus that function similarly to those in the printer according to the first embodiment are attached with like reference numerals as those used in the explanation of the printer according to the first embodiment.

FIG. 17 is a schematic diagram of a transfer/fixing apparatus 20 of a printer according to the fourth embodiment. The transfer/fixing apparatus 20 does not include a first guide plate and a second guide plate that guide transfer paper (not shown) toward the transfer fixing nip. The transfer paper is a recording sheet and has been received in the casing that is a housing and is a covering member. The reason for this configuration is described below. That is, in the printer, transfer paper fed from a registration roller pair (not shown in FIG. 17, but corresponds to 52 shown in FIG. 1) toward the transfer/fixing apparatus 20 is received in the casing 28 from an opening 28*d* provided in a bottom plate of the casing 28 of the transfer/fixing apparatus 20. A distance between the opening 28*d* and the transfer fixing nip formed in the casing 28 is very short, and when transfer paper is received in the casing 28 from the opening 28*d*, the transfer paper can be advanced in the transfer fixing nip reliably.

The opening 28*d* of the casing 28 is formed in a rectangular shape, and a short side of the opening 28*d* is shown so as to face the front shown in FIG. 17. A length W of the short side is set equal to or less than 5 millimeters, and it is a short size which has not been adopted. In the former fixing apparatus, since transfer paper fed therein carries a toner image thereon, when the size of the opening is excessively reduced, the toner image rubs against an inner wall of the opening to be disturbed. Therefore, the size of the short side (corresponding to a thickness of transfer paper) of the opening had to be set to at least several centimeters. On the other hand, in the transfer/fixing apparatus 20 of the printer, since transfer paper before received in the casing 28 does not carry a toner image thereon, even if the transfer paper rubs against an inner wall of the opening 28*d*, a toner image is not disturbed. Therefore, it is possible to set the length W of the short side equal to or less than 5 millimeters, which was a size that could not be adopted in former fixing apparatus. A bottom face of the casing 28 prevents air current generated according to behavior of transfer paper outside the casing 28 from advancing in the casing 28. It is preferable that the length W is set to a thickness of paper (thin paper to cardboard) normally used as transfer paper.

A pre-reception first guide plate 53 and a pre-reception second guide plate 54 serving as pre-reception guide members that guide a recording sheet fed from the registration roller pair before it is received in the opening 28*d* toward the opening 28*d* are arranged between a registration roller pair (not shown) and the opening 28*d* of the casing 28 serving as a covering member that covers an inlet of the transfer fixing nip. Transfer paper fed from the registration roller pair (not shown) advances in between the two guide plates. The pre-reception first guide plate 53 contacts with an image transfer face of the transfer paper to guide the transfer paper from one end of the short side of the opening 28*d* toward a central portion thereof. The pre-reception second guide plate 54 contacts with a back face of the transfer paper opposite to the image transfer face to guide the transfer paper from the other end of the short side of the opening 28*d* toward the central portion.

A spacing distance on the opening 28*d* side between the pre-reception first guide plate 53 and the pre-reception second guide plate 54 is narrower than a spacing distance on the registration roller side therebetween. Therefore, after transfer paper fed from the registration roller is received between both of the guide plates on the registration roller side where the spacing distance is relatively long, the transfer paper gradually approaches to the central side of the short side of the opening 28*d* while being guided toward the opening 28*d* side where the spacing distance is relatively short.

It is preferable that the spacing distance on the opening 28*d* side between both of the guide plates 53 and 54 is set to be slightly shorter than the length W of the opening 28*d* in the short side direction. With this configuration, stacking of a leading edge of transfer paper on a periphery of the opening 28*d* can be avoided. However, even if the configuration is adopted, the length W of the discharging opening 28*c* in the short side direction is made remarkably short, there is a possibility that the leading edge of the transfer paper is trapped by the inner wall of the opening 28*d*. While in the present printer, the length W is set equal to or less than 5 millimeters, preferably equal to or less than 2 millimeters, the length W is set to be longer than a size where stacking of a leading edge of transfer paper on the inner wall of the opening 28*d* is likely to happen exponentially according to inclination angles of both of the guide plates 53 and 54. A desirable value (the lower limit value of the length W) of the size varies according to the inclination angles of both of the guide plates 53 and 54.

Figure 18:
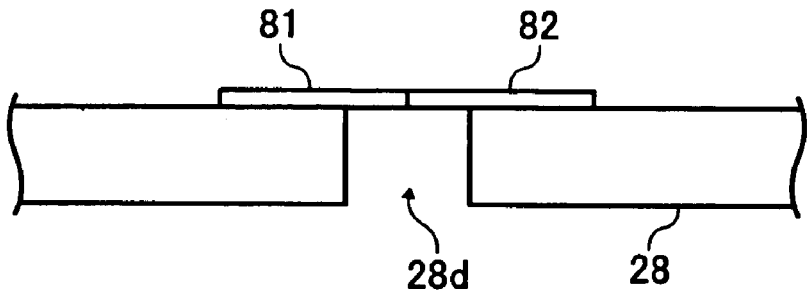
FIG. 18 is an enlarged diagram of an opening in a first modified transfer/fixing apparatus according to the fourth embodiment.

FIG. 18 is an enlarged diagram of a portion of the opening 28*d* in a first modified apparatus of the transfer/fixing apparatus 20 of the printer according to the fourth embodiment. In the first modified apparatus, a first inlet shutter-sheet 81 and a second inlet shutter-sheet 82 that are inlet shutter members are fixed on a casing inner face on a bottom wall of the casing 28. The sheets are each made of a resin sheet that is thin and flexible.

The first inlet shutter-sheet 81 is cantilevered by a casing portion of a periphery of the opening 28*d* that is continuous to one end of the opening 28*d* in the short side direction of the opening, so that a free end thereof can be flexed. As shown in FIG. 18, the free end closes a half of the opening 28*d*.

The second inlet shutter-sheet 82 is cantilevered by a casing portion of the periphery of the opening 28*d* that is continuous to the other end of the opening 28*d* in the short side direction of the opening, so that a free end thereof can be flexed. The free end closes an opening region that is not closed by the first inlet shutter-sheet 81, as shown in FIG. 18.

The inlet shutter-sheets close a whole region of the opening 28*d* by causing the free ends to contact with each other at a central portion of the opening.

Figure 19:
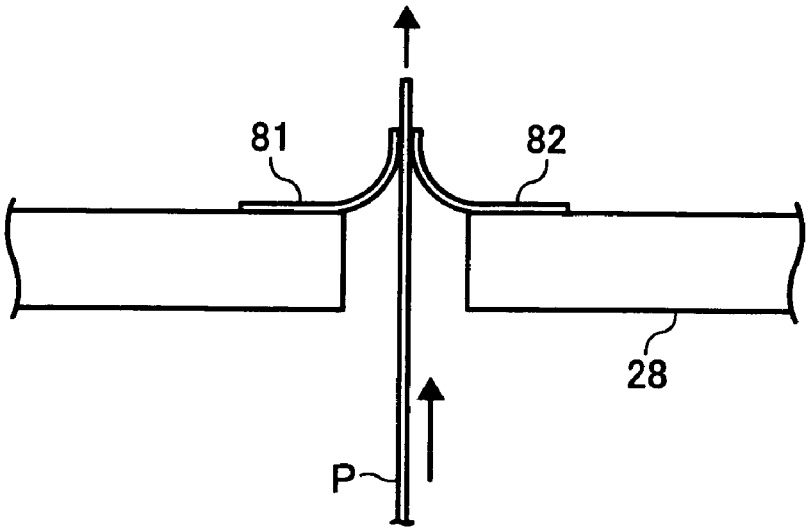

When transfer paper P is fed from a registration roller pair (not shown) to the opening 28*d*, as shown in FIG. 19, a leading edge of the transfer sheet contact with the two inlet shutter-sheets 81 and 82 or one of the sheets. Accordingly, the free ends of the inlet shutter-sheets are flexed toward inside of the casing 28 so that the opening 28*d* is opened. Thereby, the transfer paper P is received in the casing 28.

With this configuration, when transfer paper P is not fed into the casing 28, the opening 28*d* is closed by the inlet shutter-sheets, so that heat loss in the transfer/fixing apparatus can be reduced as compared with a case that the opening 28*d* is always opened. Even if a drive unit that drives the inlet shutter members is not provided, the opening 28*d* can be opened and closed by moving two inlet shutter-sheets that are the inlet shutter members for opening and closing the opening 28*d*.

The example where the casing 28 including the opening 28*d* is provided as the covering member that covers the transfer fixing nip inlet has been explained, however, the casing is not required to cover the whole transfer/fixing apparatus necessarily. The covering member can cover at least the transfer fixing nip inlet and the heating unit.

Figure 21:
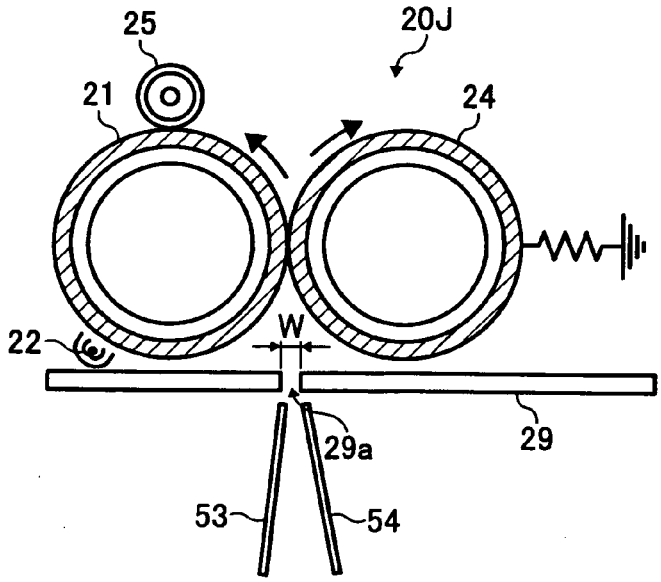
FIG. 21 is an enlarged diagram of a second modified transfer/fixing apparatus according to the fourth embodiment.

FIG. 21 is an enlarged diagram of a second modified apparatus 20J of the transfer/fixing apparatus 20 of the printer according to the fourth embodiment. The second modified apparatus 20J does not include a casing serving as a housing including the various rollers 21, 24, and 25 and the halogen lamp 22, where the rollers and the lamp are exposed in the printer. However, the shielding plate 29 for covering the transfer fixing nip and shielding the transfer fixing nip and a registration roller pair (not shown in FIG. 21, but corresponds to 52 shown in FIG. 1) positioned below the nip is provided between the nip and the pair. The opening 29*a* is provided at a portion of the shielding plate 29 serving as the coving member, which is positioned just below the transfer fixing nip. A length of the opening 29*a* in the short side direction is set equal to or less than 5 millimeters.

With this configuration, by setting the gap of the opening 29*a* in the short side direction to a short size such as equal to or less than 5 millimeters, which has not been set, an advancing amount to the opening 29*a* of air current occurring according to conveyance of transfer paper at an upstream side of the shielding plate 29 that is a covering member in the transfer paper conveying direction can be reduced. Thereby, a problem such that hot air remaining around the halogen lamp 22 is blown away by air current advancing from the opening 29*a* is avoided, so that a heat loss amount can be reduced.

Figure 22:
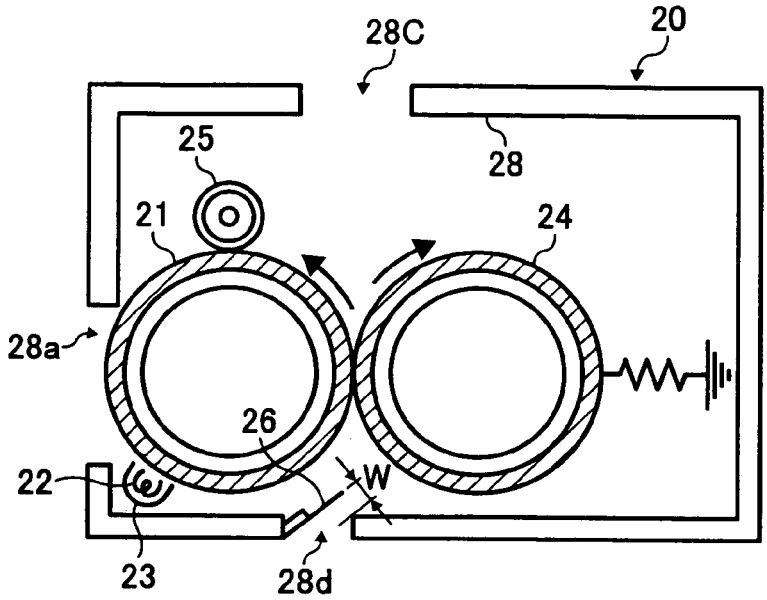
FIG. 22 is an enlarged diagram of a transfer/fixing apparatus in a printer according to a fifth embodiment of the present invention.

A printer according to a fifth embodiment of the present invention will be explained next. A basic configuration of the printer according to the fifth embodiment is similar to that of the printer according to the first embodiment unless otherwise specified, and explanation thereof is omitted. As shown in FIG. 22 and the following diagrams, members or apparatus that function similarly to those in the printer according to the first embodiment are attached with like reference numerals as those used in the explanation of the printer according to the first embodiment.

FIG. 22 is an enlarged diagram of a transfer/fixing apparatus 20 of the printer according to the fifth embodiment. In the transfer/fixing apparatus 20, the opening 28*d* is provided at a portion of a bottom plate of the casing 28 serving as a covering member that covers an inlet of the transfer fixing nip, which is positioned just below the transfer fixing nip. The first guide plate 26 is cantilevered by one of two long side inner walls of four inner walls of the rectangular opening 28*d* that face each other in a thickness direction of transfer paper fed from a registration roller pair (not shown) via a predetermined distance. A free end of the first guide plate 26 extends in a direction of the other long side inner wall and it has an oblique attitude that it gradually enters from the inlet of the opening 28*d* to the inside of the transfer/fixing apparatus 20. Differently from the first embodiment, the fifth embodiment includes only the first guide plate 26 fixed on the inner wall of the opening 28*d* and does not include a second guide plate.

The first guide plate 26 extends such that a free end thereof gradually approaches from the long side inner wall of the opening 28*d* cantilever-supporting the first guide plate 26 towards the other long side inner wall, and the free end approaches closest to the other long side inner wall. A gap W between a portion (the free end in the shown example) of the first guide plate 26 positioned nearest the other long side inner wall and the other long side inner wall is set equal to or less than 5 millimeters.

With this configuration, by setting the gap W between the first guide plate 26 and the long side inner wall of the opening 28*d* to a short size such as equal to or less than 5 millimeters, which has not been set, an amount of air current sucked from the gap into the casing is suppressed, so that a heat loss amount in the transfer/fixing apparatus 20 can be reduced.

When a flexible member flexed according to the contact with transfer paper is used as the first guide plate 26, 0 millimeter, which is included in the range of equal to or less than 5 millimeters, can be adopted as the gap W.

Figure 23:
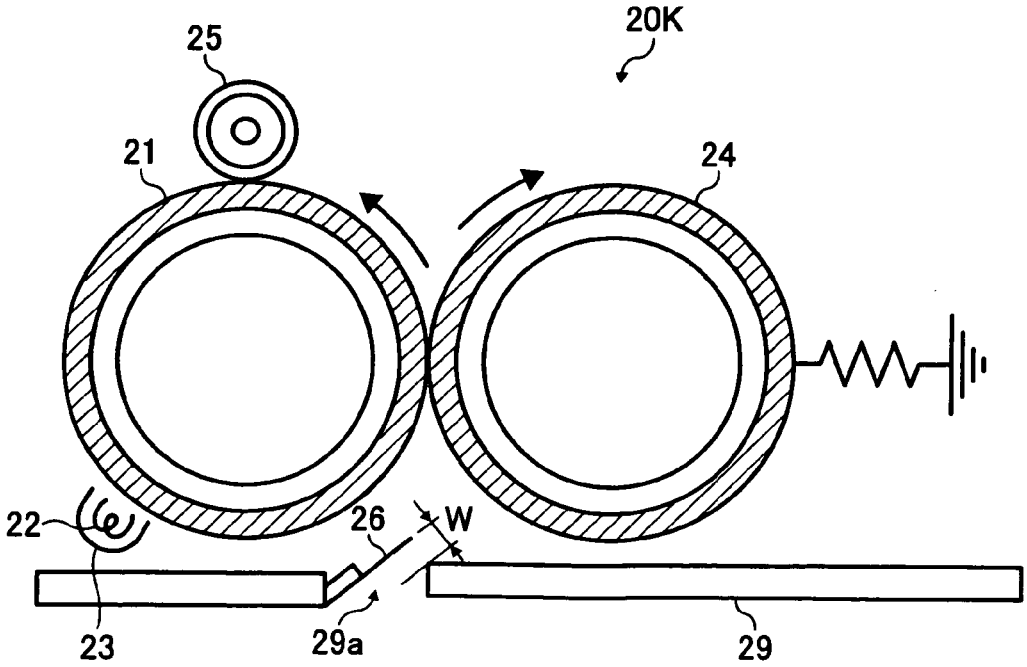
FIG. 23 is an enlarged diagram of a first modified transfer/fixing apparatus according to the fifth embodiment.

FIG. 23 is an enlarged diagram of a first modified apparatus 20K of the transfer/fixing apparatus of the printer according to the fifth embodiment. The first modified apparatus 20K does not include a casing serving as a housing including the various rollers 21, 24, and 25 and the halogen lamp 22, where the rollers and the lamp are exposed in the printer. The shielding plate 29 for covering the transfer fixing nip and shielding the transfer fixing nip and a registration roller pair (not shown in FIG. 23, but corresponds to 52 shown in FIG. 1) positioned below the nip is provided between the nip and the pair. The opening 29*a* is provided at a portion of the shielding plate 29 positioned just below the transfer fixing nip. The guide plate 26 is cantilevered by one long side inner wall of the opening 29*a*, and a gap W between the first guide plate 26 and the other long side inner wall is set equal to or less than 5 millimeters.

With this configuration, by setting the gap W between the first guide plate 26 and the long side inner wall of the opening 29*a* to a small size such as equal to or less than 5 millimeters, which has not been set, an advancing amount to the opening 29*a* of air current occurring according to conveyance of transfer paper at an upstream side of the shielding plate 29 that is a covering member in the transfer paper conveying direction can be reduced. Thereby, a problem such that hot air remaining around the halogen lamp 22 is blown away by air current advancing from the opening 29*a* is avoided, so that a heat loss amount can be reduced.

The printer where the second transfer nip that is the contacting portion between the intermediate transfer belt 11 and the transfer fixing nip 22 is formed just beside the transfer fixing nip 21 has been heretofore explained. However, the present invention is applicable to a printer with other configurations. For example, the second transfer nip can be disposed obliquely upward of, obliquely downward of, just above, or just below the transfer fixing nip. As described shown in FIG. 1 in Japanese Patent Application Laid-open No. 2004-145260, the transfer fixing nip can be disposed obliquely. The free transfer belt system as described shown in FIGS. 5 and 6 in Japanese Patent Application Laid-open No. 2004-145260, the pressurizing belt system shown in FIGS. 8 and 9 in Japanese Patent Application Laid-open No. 2004-145260, or the transfer fixing belt system as described shown in FIGS. 10 and 11 in Japanese Patent Application Laid-open No. 2004-145260 can be adopted.

The example where the present invention is applied to the printer of the electro-photographic system has been heretofore explained. However, the present invention is applicable to an image forming apparatus forming an image utilizing a direct recording system. The direct recording system is a system that directly forms a toner image on a recording medium or member or an intermediate recording member by causing toner groups flied from a toner flying device in a dot manner to directly adhere on the recording member or the intermediate recording member to form a pixel image. The direct recording system has been adopted in an image forming apparatus described in Japanese Patent Application Laid-open No. 2002-307737 and the like.

In the apparatuses shown in FIGS. 1, 4, 8, 13, and 14, a plate made from flexible material is used as the first guide plate 26, and it is displaced by flexing the free end thereof according to contact with transfer paper P that is the recording sheet. With this configuration, even if the mechanism for rotating the first guide plate such as the apparatus shown in FIG. 11 is not provided, the receiving opening of the casing 28 can be opened according to flexing of the free end portion of the first guide plate 26.

In the apparatuses shown in FIGS. 1, 4, 8, 13, and 15, the transfer fixing roller 21 that is the transfer roller is used as the transfer member, the pressurizing roller that is the nip forming roller is used as the nip forming member, and the contacting portion between the first guide plate 26 and the second guide plate 27 that is the second guide member is positioned in the upstream region of the transfer fixing nip in the surface moving directions of both of the rollers and in the region where circumferential faces of both of the rollers face each other. With this configuration, transfer paper P is guided near the transfer fixing nip positioned between both of the rollers by the first guide plate 26 and the second guide plate 27 and it is positioned accurately just before the nip. Thereby, an image with high quality that does not include position deviation can be formed.

In the apparatus shown in FIG. 1, the paper feed cassette 50 serving as the sheet accommodating unit that accommodates transfer paper P to be fed toward the transfer fixing nip is provided, and the sizes of the contacting faces of the first guide plate 26 and the second guide plate 27 with transfer paper P in a direction perpendicular to the paper conveying direction are set to be larger than a size of transfer paper P with the maximum size that can be accommodated in the paper feed cassette 50 in a direction perpendicular to the paper conveying direction. Thereby, even if transfer paper P with the maximum size is used, the transfer paper P can be guided toward the transfer fixing nip by the first guide plate 26 and the second guide plate 27 reliably.

In the fourth modified apparatus in the transfer/fixing apparatus of the printer according to the first embodiment, as shown in FIG. 9, a plate having at least free end that can be displaced according to contact with transfer paper by dividing at least the free end into many pieces in a direction perpendicular to the paper conveying direction is used as the first guide plate 26. With this configuration, release of heat or intake of external air from the receiving opening due to a state where a region in the region of the free end of the first guide plate in the widthwise direction thereof that does not contact with transfer paper is flexed so that a slight gap is formed between the free end and the second guide plate can be avoided.

In the printer according to the third embodiment, as shown in FIG. 12, the contact face of the first guide plate 26 with transfer paper is formed in a curved face extending from the receiving opening of the casing 28 to the transfer fixing nip in an arc shape. With this configuration, stacking of a leading edge of transfer paper on the first guide plate 26 can be avoided.

In the apparatuses shown in FIGS. 8 and 15, since the shutter member 35 that opens and closes the discharging opening 28*c* of the casing 28 according to drive ON and OFF of the drive source, only when the transfer paper P is discharged from the discharging opening 28*c*, the discharging opening 28*c* is opened, or the discharging opening 28*c* is continuously opened during continuous paper discharging in a continuous printing operation, so that heat loss can be largely reduced.

In the printers and the respective modified apparatus according to respective embodiments, since the layout that the discharging opening of the casing 28 is directed upwardly in the vertical direction is adopted, dew condensation due to remaining excessive heat in the casing 28 can be suppressed by the above reasons.

In the first embodiment, since toner having Wadell's practical sphericity equal to or more than 0.8 is used as toner for forming a toner image, images with high quality can be formed, without any disturbance caused during transfer.

In the embodiment of the present invention, by substantially simultaneously performing transferring processing and fixing processing of a visible image to a recording sheet in the transfer/fixing apparatus, the recording sheet fixed with the visible image is conveyed after the visible image has been transferred on the recording sheet. Therefore, a problem such that an unfixed visible image is disturbed due to rubbing against a guide plate or the like can be avoided.

According to the embodiment of the present invention, by setting the gap between the first guide plate and the second plate to a short size such as equal to or less than 5 millimeters, which has not been adopted, an advancing amount to the transfer/fixing apparatus of air current occurring according conveyance of a recording sheet can be reduced. Accordingly, a heat loss amount due to the advancing of air current can be reduced.

According to the embodiment of the present invention, by setting the length of the opening in the covering member in a short side direction thereof to a short size such as equal to or less than 5 millimeters, which has not been adopted, an advancing amount to the opening of air current occurring at an upstream side of the covering member in a conveying direction of the recording sheet according to conveyance of a recording sheet can be reduced. Accordingly, a problem such that hot air remaining around the heating unit is blown away by air current advancing from the opening is avoided, so that a heat loss amount due to the advancing of air current can be reduced.

According to the embodiment of the present invention, by setting the gap between the inner wall of the opening of the covering member and the guide member that guides a recording sheet advanced into the opening to a short size such as equal to or less than 5 millimeters, which has not been adopted, an advancing amount of air current occurring at an upstream side of the covering member in a direction of the recording sheet conveyance according to conveyance of a recording sheet can be reduced. Accordingly, a problem such that hot air remaining around the heating unit is blown away according to air current entering from the opening is avoided, so that a heat loss amount due to entrance of air current can be reduced.

Preferably, the embodiment of the present invention provides a transfer/fixing apparatus that includes a transfer member that transfers a visible image carried on an image carrier to an endlessly moving surface of the transfer member, a heating unit that heats the visible image transferred on the surface of the transfer member, and a nip forming member that causes an endless moving surface thereof to contact with the surface of the transfer member to form a nip between both of the surfaces, where the visible image on the surface of the transfer member is fixed on a recording sheet nipped in the nip while being transferred on the recording sheet, where the transfer member, the heating unit, and the nip forming member are covered with a casing including a surface-exposing opening that exposes a portion of a surface of the transfer member to cause the portion to face the image carrier, a receiving opening that receives the recording sheet fed from the outside to guide the same to the nip, a discharging opening that discharges the recording sheet discharged from the nip to the outside, and a guide unit that guides the recording sheet received from the receiving opening toward the nip, and the guide unit is structured that, while the receiving opening is closed by causing a first guide member whose end portion positioned on the side of the receiving opening is cantilevered by a peripheral edge of the receiving opening between the receiving opening and the nip and a second guide member fixed to the peripheral edge of the receiving opening so as to face the first guide member to contact with each other, the recording sheet advanced in between both of the guide members is guided toward the nip, and the receiving opening is opened by displacing a free end of the first guide member according to contact with the recording sheet to separate the first guide member from the second guide member.

Preferably, the embodiment of the present invention provides a transfer/fixing apparatus that includes a transfer member that transfers a visible image carried on an image carrier to an endlessly moving surface of the transfer member, a heating unit that heats the visible image transferred on the surface of the transfer member, and a nip forming member that causes an endless moving surface thereof to contact with the surface of the transfer member to form a nip between both of the surfaces, where the visible image on the surface of the transfer member is fixed on a recording sheet nipped in the nip while being transferred on the recording sheet, where the transfer member, the heating unit, and the nip forming member are covered with a casing including a surface-exposing opening that exposes a portion of a surface of the transfer member to cause the portion to face the image carrier, a receiving opening that receives the recording sheet fed from the outside to guide the same to the nip, a discharging opening that discharges the recording sheet discharged from the nip to the outside, and a guide unit that guides the recording sheet received from the receiving opening toward the nip, and the guide unit is structured that, while an opening size of the receiving opening is narrowed to a size of a gap of equal to or less than 250 micrometers by a first guide member whose end portion positioned on the side of the receiving opening is cantilevered by a peripheral edge of the receiving opening between the receiving opening and the nip and a second guide member fixed to the peripheral edge of the receiving opening so as to face the first guide member with each other via the gap of equal to or less than 250 micrometers, the recording sheet that advances in between both of the guide members is guided toward the nip, and the size of the receiving opening is further enlarged by displacing a free end of the first guide member according to contact with the recording sheet.

In these configurations, by covering the first endlessly moving member, the heating unit, and the second endlessly moving member to cause heat from the heating unit to remain in the casing, the heat loss amount in the transfer/fixing apparatus can be reduced as compared with the transfer fixing apparatus. The receiving opening in the casing is closed by contact between the first guide member and the second guide member or it is opened by such a minute amount as equal to or less 250 micrometers, which corresponds to a thickness of an ordinary cardboard, while a recording sheet is not fed into the transfer/fixing apparatus. Accordingly, by suppressing ventilation from the inside of the casing to the outside thereof via the receiving opening or suppressing ventilation from the receiving opening to the outside of the casing via the inside of the casing and the surface-exposing opening or the discharging opening, the heat loss amount in the transfer/fixing apparatus can be further reduced.

The embodiment of the present invention can provide an image forming apparatus that includes an image carrier that carries a visible image on a surface thereof, a visible image forming unit that forms a visible image on the image carrier, a transfer/fixing apparatus that fixes the visible image on a recording sheet while transferring the visible image from the image carrier to the recording sheet, and a sheet supply path that supplies a recording sheet to the transfer/fixing apparatus, where the transfer/fixing apparatus includes a transfer member that transfers a visible image carried on the image carrier to an endlessly moving surface of the transfer member, a heating unit that heats the visible image transferred on the surface of the transfer member, and a nip forming member that causes an endless moving surface thereof to contact with the surface of the transfer member to form a nip between both of the surfaces, where the visible image on the surface of the transfer member is fixed on a recording sheet nipped in the nip while being transferred on the recording sheet, where a guide member that is disposed at a position to be heated by the heating unit and guides the recording sheet fed from the sheet supply path toward the nip while contacting with the recording sheet is provided in the transfer/fixing apparatus, and the sheet supply path is configured so as to feed the recording sheet positioned inside the sheet supply path toward the guide member. In this configuration, prior to advancing of a recording sheet fed from the sheet supply path toward the transfer/fixing apparatus into the nip in the transfer/fixing apparatus, the guide member that accumulates heat therein due to heating performed by the heating unit in the transfer/fixing apparatus is caused to contact with a recording sheet. By conducting heat in the guide member to the recording sheet according to the contact, the recording sheet is advanced in the nip after it has been preheated. In this configuration, by utilizing accumulated heat in the guide member for preheating instead of discharging heat to the atmosphere, the heat loss amount in the transfer/fixing apparatus can be reduced as compared with the apparatus.

In the configuration utilizing the preheating, it is preferable that the transfer member, the heating unit, and the nip forming member in the transfer/fixing apparatus are covered with a casing including a surface-exposing opening that exposes a portion of a surface of the transfer member to cause the portion to face the image carrier, a receiving opening that receives the recording sheet fed from the outside to guide the same to the nip, a discharging opening that discharges the recording sheet discharged from the nip to the outside, and guide units that guide the recording sheet received from the receiving opening toward the nip. It is preferable that a first guide member whose end portion positioned on the side of the receiving opening is cantilevered by a peripheral edge of the receiving opening between the receiving opening and the nip and a second guide member fixed to the peripheral edge of the receiving opening so as to face the first guide member are provided as the guide members, so that the recording sheet advanced in between both of the guide members toward the nip is guided while the receiving opening is closed by causing both of the guide members to contact with each other, and the receiving opening is opened by displacing a free end of the first guide member according to contact with the recording sheet to separate the first guide member from the second guide member. Also, it is preferable that use a member made from flexible material to displace the free end by flexing the free end according to contact thereof with a recording sheet. Also, it is preferable that a transfer roller is used as the transfer member, a nip forming roller is used as the nip forming member, and a contact region between the first guide member and the second guide member is positioned in an upstream region of the nip in surface moving directions of both of the rollers and in a region where circumferential faces of both of the rollers face to each other. Also, it is preferable that a sheet accommodating unit that receives the recording sheet for supplying the recording sheet toward the nip is provided and members whose sizes of faces contacting with the recording sheet in a direction perpendicular to a sheet conveying direction are set to be larger than a size of a recording sheet with the maximum size that can be accommodated in the sheet accommodating unit are used as the first guide member and the second guide member. Also, it is preferable that the first guide member or the second guide member are configured so as to allow displacement thereof by dividing at least a free end thereof into many pieces in a direction perpendicular to the sheet conveying direction. It is preferable that a face of the first guide member contacting with the recording sheet is formed in a curved face extending from the receiving opening toward the nip in an arc shape. It is preferable that a shutter that opens and closes the discharging opening according to drive ON and OFF operations to a drive source is provided. It is preferable that a layout directing the discharging opening vertically in an upward direction is adopted.

A preferable example of the embodiment of the present invention includes a transfer/fixing apparatus that includes a transfer member that transfers a visible image carried on an image carrier to a surface of the transfer member, a heating unit that heats the visible image transferred on the surface of the transfer member, a nip forming member that causes a surface thereof to contact with the surface of the transfer member to form a nip, and a housing including the transfer member, the heating member, and the nip forming member therein, where, while a visible image on the transfer member is fixed on a recording sheet that has been received in the housing from an opening provided in the housing to be nipped in the nip, while the visible image on the transfer member is being transferred on the recording sheet, where a length of the opening in a short side direction thereof is set equal to or less than 5 millimeters. In this aspect, it is further preferable to set the length of the opening in the short side direction equal to or less than 2 millimeters. It is further preferable that a pre-reception guide member that guides a recording sheet after fed out of the sheet supply unit and before received in the opening in the transfer/fixing apparatus toward the opening is provided.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising;

an image forming unit configured to form a visible toner image;

an image carrier configured to carry the toner image formed thereon by the image forming unit; and a transferring apparatus configured to receive the toner image from the image carrier and to transfer the toner image onto a recording medium, wherein the transfer apparatus includes a transfer member configured to receive the toner image from the toner image carrier;

a heating unit configured to heat the transfer member including the image thereon;

a nip-forming member configured to form a nip between the transfer member and the nip-forming member, and to sandwich the recording medium in the nip to transfer the toner image from the transfer member onto the recording medium; and a first guide member and a second guide member configured to guide the recording medium toward the nip, the first guide member and the second guide member being arranged so as to form a substantial V-shape with a tip of the V-shape being toward the nip, and a minimum distance between the first guide member and the second guide member being equal to or less than 5 millimeters.

2. The image forming apparatus according to claim 1, wherein at least a part near the tip of at least one of the first guide member and the second guide member is flexible.

3. An image forming apparatus comprising:

an image forming unit configured to form a visible toner image;

an image carrier configured to carry the toner image formed thereon by the image forming unit; and a transferring apparatus configured to receive the toner image from the image carrier and to transfer the toner image onto a recording medium, wherein the transfer apparatus includes a transfer member configured to receive the toner image from the image carrier;

a heating unit configured to heat the transfer member including the toner image;

a nip-forming member configured to form a nip between the transfer member and the nip-forming member, and to sandwich the recording medium in the nip to transfer the toner image from the transfer member onto the recording medium; and a covering member configured to cover an inlet of the nip and that has a gap through which the recording medium advances toward the nip, the gap being equal to or less than 5 millimeters.

4. The image fqrming apparatus according to claim 3, wherein the covering member is configured to prevent an air current that is generated by a conveyance of the recording medium from flowing into an area around the nip.

5. The image forming apparatus according to claim 3, wherein the gap is equal to or less than 2 millimeters.

6. The image forming apparatus according to claim 3, wherein the gap is approximately equal to a thickness of the recording medium.

7. The image forming apparatus according to claim 3, further comprising a shutter member configured to open and close the gap.

8. The image forming apparatus according to claim 7, wherein at least a part of the shutter member is flexible.

9. The image forming apparatus according to claim 3, wherein the covering member is configured to be a part of a housing member of the transferring apparatus.

10. The image forming apparatus according to claim 3, further comprising a guide member that is disposed between the covering member and the nip and at a slant over the gap, and configured to guide the recording medium advancing through the gap toward the nip, a minimum distance between the guide member and the covering member being equal to or less than 5 millimeters.

11. An image forming apparatus comprising:

a transferring apparatus configured to carry a toner image and to transfer the toner image onto a recording medium, wherein the transfer apparatus includes a transfer member configured to carry the toner image;

a heating unit configured to heat the transfer member including the toner image thereon;

a nip-forming member configured to form a nip between the transfer member and the nip-forming member, and to sandwich the recording medium in the nip to transfer the toner image from the transfer member onto the recording medium; and a first guide member and a second guide member configured to guide the recording medium toward the nip, wherein a minimum distance between the first guide member and the second guide member is equal to or less than 5 millimeters.

12. The image forming apparatus according to claim 11, wherein at least a part near the tip of at least one of the first guide member and the second guide member is flexible.

13. The image forming apparatus according to claim 12, wherein the first guide member is divided into plural parts in a direction normal to a direction of carrying the recording medium.

14. The image forming apparatus according to claim 11, wherein the heating unit is configured to heat the first guide member, and the recording medium contacts the heated first guide member to be preheated before being carried into the nip.

15. The image forming apparatus according to claim 11, wherein a dimension of the first guide member and the second guide member in a direction normal to a direction of carrying the recording medium is larger than a dimension of a maximum size of the recording medium.

* * * * *